US011655088B2

(12) United States Patent
McCree et al.

(10) Patent No.: US 11,655,088 B2
(45) **Date of Patent: *May 23, 2023**

(54) CARRIER FOR CONTAINERS

(71) Applicant: Graphic Packaging International, LLC, Atlanta, GA (US)

(72) Inventors: Justin McCree, Bristol (GB); Steve M. Gould, Bristol (GB)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/487,131

(22) Filed: Sep. 28, 2021

(65) Prior Publication Data

US 2022/0097941 A1 Mar. 31, 2022

Related U.S. Application Data

(60) Provisional application No. 63/208,646, filed on Jun. 9, 2021, provisional application No. 63/136,400, filed
(Continued)

(51) Int. Cl.
*B65D 71/72* (2006.01)
*B65D 71/42* (2006.01)
(Continued)

(52) U.S. Cl.
CPC ..... *B65D 71/72* (2013.01); *B31B 50/262* (2017.08); *B65D 71/42* (2013.01); *B31B 50/20* (2017.08);
(Continued)

(58) Field of Classification Search
CPC ..... B31B 50/20; B31B 50/86; B31B 2100/00; B65D 71/40; B65D 71/42; B65D 71/46; B65D 71/72; B65D 75/00; B65D 2571/00141; B65D 2571/00259; B65D 2571/0029; B65D 2571/00444; B65D 2571/00561; B65D 2571/0066
(Continued)

(56) References Cited

U.S. PATENT DOCUMENTS 1,527,399 A 2/1925 Davidson
2,289,859 A 7/1942 Arthur
(Continued)

FOREIGN PATENT DOCUMENTS

AT 399701 B 7/1995
CA 2133827 10/1993
(Continued)

OTHER PUBLICATIONS

U.S. Appl. No. 16/426,050, filed May 30, 2019.
(Continued)

*Primary Examiner* — Bryon P Gehman
(74) *Attorney, Agent, or Firm* — Womble Bond Dickinson (US) LLP

(57) ABSTRACT

A carrier for holding a plurality of containers includes a top panel having a plurality of container retention openings for at least partially receiving a respective container of the plurality of containers, at least one container retention flap foldably connected to the top panel at a fold line, and at least one reinforcement panel interrupting the fold line and positioned between the top panel and the at least one container retention flap.

54 Claims, 14 Drawing Sheets

Related U.S. Application Data on Jan. 12, 2021, provisional application No. 63/120,863, filed on Dec. 3, 2020, provisional application No. 63/086,681, filed on Oct. 2, 2020, provisional application No. 63/085,365, filed on Sep. 30, 2020.

(51) Int. Cl.
*B31B 50/20* (2017.01)
*B31B 50/26* (2017.01)
*B31B 50/86* (2017.01)
*B31B 100/00* (2017.01)

(52) U.S. Cl.
CPC ..... *B31B 50/86* (2017.08); *B31B 2100/00* (2017.08); *B65D 2571/0029* (2013.01); *B65D 2571/0066* (2013.01); *B65D 2571/00141* (2013.01); *B65D 2571/00259* (2013.01); *B65D 2571/00444* (2013.01); *B65D 2571/00561* (2013.01)

(58) Field of Classification Search
USPC ..... 206/153, 427
See application file for complete search history.

(56) References Cited

U.S. PATENT DOCUMENTS 2,320,440 A 6/1943 Kruea
2,331,038 A 10/1943 Meller
2,397,376 A 3/1946 Caldwell
2,397,716 A 4/1946 Wendler
2,522,950 A 9/1950 Keith
2,594,376 A 4/1952 Arneson
2,594,377 A 4/1952 Arneson
2,737,326 A 3/1956 Toensmeier
2,798,603 A 7/1957 Grinspoon
2,950,041 A 8/1960 Stone
2,965,410 A 12/1960 Hughes
3,001,647 A 9/1961 Liss
3,046,711 A 7/1962 Harrison
3,061,141 A 10/1962 Cote
3,094,210 A 6/1963 Van Der Berg
3,099,475 A 7/1963 Manizza
3,118,537 A 1/1964 Copping
3,128,034 A 4/1964 Weiss
3,137,109 A 6/1964 Rapata
3,146,885 A 9/1964 Grantham
3,156,358 A 11/1964 Randrup
3,200,944 A 8/1965 Rapata
3,223,308 A 12/1965 Weiss
3,245,711 A 4/1966 Dantoin
3,257,066 A 6/1966 Williams
3,281,180 A 10/1966 Spery
3,302,784 A 2/1967 Copping
3,387,879 A 6/1968 Wood
3,404,912 A 10/1968 Watts
3,410,596 A 11/1968 Slevin, Jr.
3,432,202 A 3/1969 Ebelhardt
3,463,535 A 8/1969 Beart
3,528,697 A 9/1970 Wood
3,587,847 A 6/1971 Graser
3,601,439 A 8/1971 Pitch
3,612,266 A 10/1971 Graser
D222,579 S 11/1971 Oglesbee
3,627,121 A 12/1971 Deasy
3,653,503 A 4/1972 Arneson
3,693,787 A 9/1972 Duerr
3,698,550 A 10/1972 Graser
3,701,416 A 10/1972 Lawrence
3,722,945 A 3/1973 Wood
3,726,558 A 4/1973 Klygis
3,734,278 A 5/1973 Kerrigan
3,876,066 A 4/1975 Klygis
3,897,873 A 8/1975 Graser
3,924,739 A 12/1975 Gravesteijn
3,942,631 A 3/1976 Sutherland et al.
4,029,204 A 6/1977 Manizza
4,111,298 A 9/1978 Mascia
4,120,396 A 10/1978 Mascia
4,136,772 A 1/1979 Mascia
4,155,502 A 5/1979 Forte
4,190,149 A 2/1980 Oliff et al.
D257,001 S 9/1980 Oliff
4,244,617 A 1/1981 Manizza
4,304,329 A 12/1981 Graser
D265,292 S 7/1982 Killy
4,339,032 A 7/1982 Wood
D265,979 S 8/1982 Arfert
4,372,599 A 2/1983 Kiedaisch et al.
4,378,879 A 4/1983 Killy
4,382,505 A 5/1983 Sutherland et al.
4,441,611 A 4/1984 Sommariva
4,453,630 A 6/1984 Helms
4,471,870 A 9/1984 Uhlig
4,523,676 A 6/1985 Barrash
D294,331 S 2/1988 Panazzolo
4,784,266 A 11/1988 Chaussadas
D304,017 S 10/1989 Oliff
4,911,288 A 3/1990 Dantoin, Jr.
4,974,726 A 12/1990 Klygis et al.
5,002,225 A 3/1991 Bienaime
5,065,862 A 11/1991 Mousseau
5,103,971 A 4/1992 Schuster
5,125,506 A 6/1992 Galbierz et al.
5,135,104 A 8/1992 Jorba
5,139,147 A 8/1992 Sutherland
D329,807 S 9/1992 Heider
5,188,225 A 2/1993 Jorba
5,193,673 A 3/1993 Rathbone et al.
5,201,412 A 4/1993 Schuster et al.
5,230,425 A 7/1993 Edqvist et al.
5,246,113 A 9/1993 Schuster
5,263,299 A 11/1993 Galbierz et al.
5,267,644 A 12/1993 Tsao
5,282,348 A 2/1994 Dampier et al.
5,297,673 A 3/1994 Sutherland
5,310,050 A 5/1994 Sutherland
5,310,051 A 5/1994 Sutherland
5,314,224 A 5/1994 Bates
5,318,178 A 6/1994 Davies et al.
5,323,895 A 6/1994 Sutherland et al.
5,328,024 A 7/1994 Sutherland
5,335,774 A 8/1994 Ganz
5,351,815 A 10/1994 Fogle et al.
5,351,816 A 10/1994 Sutherland et al.
5,351,817 A 10/1994 Sutherland
5,355,999 A 10/1994 Sutherland
5,360,104 A 11/1994 Sutherland
5,390,784 A 2/1995 Sutherland
5,407,065 A 4/1995 Sutherland
5,415,278 A 5/1995 Sutherland
5,425,446 A 6/1995 Weaver
5,443,153 A 8/1995 Sutherland
5,445,262 A 8/1995 Sutherland
5,452,799 A 9/1995 Sutherland
5,484,053 A 1/1996 Harris
5,485,914 A 1/1996 Martin
5,487,464 A 1/1996 Galbierz et al.
5,490,593 A 2/1996 Gordon et al.
5,503,267 A 4/1996 Sutherland
5,520,283 A 5/1996 Sutherland
5,524,756 A 6/1996 Sutherland
5,551,566 A 9/1996 Sutherland
5,553,704 A 9/1996 Gordon et al.
5,553,705 A 9/1996 Bakx
5,573,111 A 11/1996 Gordon
5,590,776 A 1/1997 Galbierz
5,593,027 A 1/1997 Sutherland
5,609,247 A 3/1997 Appleton
5,609,251 A 3/1997 Harris
5,609,379 A 3/1997 Harrelson
5,639,137 A 6/1997 Bakx
5,682,982 A 11/1997 Stonehouse
5,706,936 A 1/1998 Bernstein

(56) References Cited

U.S. PATENT DOCUMENTS

| | | | |
|---|---|---|---|
| 5,711,419 | A | 1/1998 | Beales et al. |
| 5,735,394 | A | 4/1998 | Harrelson |
| 5,746,310 | A | 5/1998 | Slomski |
| 5,762,193 | A | 6/1998 | Marco |
| 5,791,463 | A | 8/1998 | Negelen |
| 5,816,391 | A | 10/1998 | Harris |
| 5,845,776 | A | 12/1998 | Galbierz et al. |
| 5,878,876 | A | 3/1999 | Galbierz et al. |
| 5,960,945 | A | 10/1999 | Sutherland |
| 6,039,181 | A | 3/2000 | Whiteside |
| 6,059,099 | A | 5/2000 | Galbierz |
| 6,082,532 | A | 7/2000 | Miess |
| 6,145,656 | A | 11/2000 | Marco |
| 6,293,392 | B1 | 9/2001 | Galbierz |
| 6,315,111 | B1 | 11/2001 | Sutherland |
| 6,394,272 | B1 | 5/2002 | Domansky |
| 6,896,130 | B2 | 5/2005 | Theelen |
| D506,925 | S | 7/2005 | Plumer |
| 7,011,209 | B2 | 3/2006 | Sutherland et al. |
| 7,690,507 | B2 | 4/2010 | Sutherland |
| 7,721,878 | B2 | 5/2010 | Requena |
| 7,762,397 | B2 | 7/2010 | Coltri-Johnson et al. |
| 7,789,231 | B2 | 9/2010 | Requena |
| 7,823,721 | B2 | 11/2010 | Sutherland et al. |
| 8,056,709 | B2 | 11/2011 | Sutherland |
| 8,096,413 | B2 | 1/2012 | DePaula |
| 8,162,135 | B2 | 4/2012 | Oliveira |
| 8,353,398 | B2 | 1/2013 | DePaula et al. |
| 8,387,784 | B2 | 3/2013 | Gonzalez et al. |
| 8,443,968 | B2 | 5/2013 | DePaula |
| 8,464,866 | B2 | 6/2013 | Sutherland et al. |
| 8,469,184 | B2 | 6/2013 | Spivey, Sr. |
| 8,602,209 | B2 | 12/2013 | Jones et al. |
| 8,631,932 | B2 | 1/2014 | Holley, Jr. |
| 8,701,878 | B2 | 4/2014 | Spivey, Sr. |
| 8,925,720 | B2 | 1/2015 | Sutherland et al. |
| 8,936,149 | B2 | 1/2015 | Smalley |
| 8,955,674 | B2 | 2/2015 | Spivey, Sr. et al. |
| 9,079,699 | B2 | 7/2015 | Holley, Jr. |
| 9,169,050 | B2 | 10/2015 | Spivey, Sr. |
| 9,284,090 | B2 | 3/2016 | Lettre |
| 9,359,093 | B2 | 6/2016 | DePaula et al. |
| 9,376,250 | B2 | 6/2016 | Spivey, Sr. |
| D767,408 | S | 9/2016 | Shuster |
| 9,446,891 | B2 | 9/2016 | Jones et al. |
| 9,511,916 | B2 | 12/2016 | Holley, Jr. |
| 9,669,976 | B2 | 6/2017 | Kastanek et al. |
| 9,676,535 | B2 | 6/2017 | Spivey, Sr. |
| 10,077,131 | B2 | 9/2018 | Lettre |
| D881,021 | S | 4/2020 | Bandinu |
| D881,718 | S | 4/2020 | Bandinu |
| 10,836,550 | B2 | 11/2020 | Zacherle |
| D918,057 | S | 5/2021 | L'Heureux |
| D918,058 | S | 5/2021 | L'Heureux |
| 11,014,727 | B2 | 5/2021 | McCree |
| D920,809 | S | 6/2021 | Chesnet et al. |
| D921,493 | S | 6/2021 | Chesnet |
| D923,416 | S | 6/2021 | Luciano |
| 11,027,905 | B2 | 6/2021 | Ford |
| 11,180,301 | B2 | 11/2021 | Smalley |
| D944,656 | S | 3/2022 | Spivey, Sr. |
| D946,416 | S | 3/2022 | Smalley |
| D946,417 | S | 3/2022 | Gonzalez Manzano |
| D946,418 | S | 3/2022 | Gonzalez Manzano |
| D946,419 | S | 3/2022 | Gonzalez Manzano |
| D946,420 | S | 3/2022 | Gonzalez Manzano |
| D946,421 | S | 3/2022 | Gonzalez Manzano |
| 11,261,013 | B2 | 3/2022 | Smalley |
| 11,286,094 | B2 | 3/2022 | Gonzalez Manzano |
| D955,889 | S | 6/2022 | Gonzalez Manzano |
| D955,890 | S | 6/2022 | Gonzalez Manzano |
| D956,574 | S | 7/2022 | Gonzalez Manzano |
| 11,401,095 | B2 | 8/2022 | Rosenbrien |
| 11,420,802 | B2 | 8/2022 | Kooc |
| D962,789 | S | 9/2022 | Noel |
| 2002/0195371 | A1 | 12/2002 | Brown |
| 2003/0080004 | A1 | 5/2003 | Olsen et al. |
| 2003/0213705 | A1 | 11/2003 | Woog |
| 2004/0206639 | A1 | 10/2004 | Karlsson |
| 2004/0211695 | A1 | 10/2004 | Karlsson |
| 2004/0226833 | A1 | 11/2004 | Daniel |
| 2005/0127151 | A1 | 6/2005 | Johnson |
| 2005/0199513 | A1 | 9/2005 | Bakx et al. |
| 2006/0255114 | A1 | 11/2006 | Hand et al. |
| 2007/0080084 | A1 | 4/2007 | Sutherland |
| 2007/0163908 | A1 | 7/2007 | Sutherland |
| 2009/0101526 | A1 | 4/2009 | Sutherland et al. |
| 2009/0127147 | A1 | 5/2009 | Sutherland |
| 2010/0078337 | A1 | 4/2010 | Sutherland et al. |
| 2010/0264043 | A1 | 10/2010 | DePaula |
| 2011/0000799 | A1 | 1/2011 | Gonzalez |
| 2012/0138489 | A1 | 6/2012 | Holley, Jr. |
| 2015/0191287 | A1 | 7/2015 | L'Heureux et al. |
| 2016/0325899 | A1 | 11/2016 | L'Heureux et al. |
| 2018/0111734 | A1 | 4/2018 | Jego |
| 2018/0222650 | A1 | 8/2018 | Zacherle |
| 2018/0362234 | A1 | 12/2018 | L'Heureux et al. |
| 2019/0119019 | A1 | 4/2019 | Patton |
| 2020/0010255 | A1 | 1/2020 | Zacherle et al. |
| 2020/0079564 | A1 | 3/2020 | Ford |
| 2020/0189817 | A1 | 6/2020 | Smalley |
| 2020/0189818 | A1 | 6/2020 | McCree |
| 2020/0189819 | A1 | 6/2020 | McCree |
| 2020/0189821 | A1 | 6/2020 | Smalley |
| 2020/0189822 | A1 | 6/2020 | Smalley |
| 2020/0223612 | A1 | 7/2020 | Swenson |
| 2021/0061502 | A1 | 3/2021 | Johnston |
| 2021/0094742 | A1 | 4/2021 | Gonzalez Manzano |
| 2021/0276776 | A1 | 9/2021 | Zammit |
| 2021/0316921 | A1 | 10/2021 | Holtz |
| 2021/0331847 | A1 | 10/2021 | Gonzalez Manzano |
| 2021/0331848 | A1 | 10/2021 | Gonzalez Manzano |
| 2021/0339928 | A1 | 11/2021 | Blin |
| 2022/0009685 | A1 | 1/2022 | Thompson |
| 2022/0097941 | A1 | 3/2022 | McCree |

FOREIGN PATENT DOCUMENTS

| | | | |
|---|---|---|---|
| DE | 298 13 672 | U1 | 11/1998 |
| DE | 203 19 247 | U1 | 5/2004 |
| DE | 10 2009 059 047 | A1 | 6/2011 |
| EP | 0 051 413 | A1 | 5/1982 |
| EP | 0 060 504 | A2 | 9/1982 |
| EP | 0 057 437 | B1 | 5/1985 |
| EP | 0 496 807 | | 6/1993 |
| EP | 0 636 096 | | 2/1995 |
| EP | 0 715 593 | A1 | 6/1996 |
| EP | 0 398 835 | B1 | 10/1996 |
| EP | 2 067 713 | A1 | 6/2009 |
| EP | 1 528 007 | B1 | 10/2010 |
| EP | 2739547 | B1 | 7/2017 |
| EP | 3 666 684 | A1 | 6/2020 |
| EP | 3 666 685 | A1 | 6/2020 |
| FR | 2 737 196 | A1 | 1/1997 |
| GB | 1 256 684 | | 12/1971 |
| GB | 2 321 229 | A | 7/1998 |
| GB | 9006736716 | | 8/2019 |
| GB | 2591535 | A | 8/2021 |
| GB | 6161591 | | 9/2021 |
| JP | 10-297668 | A | 11/1998 |
| JP | 2001-519300 | A | 10/2001 |
| JP | 2003-146359 | | 5/2003 |
| JP | 2004-189243 | A | 7/2004 |
| JP | 2015-048088 | A | 3/2015 |
| KR | 10-2005-0051616 | A | 6/2005 |
| KR | 10-2020-0106806 | A | 9/2020 |
| KR | 301130233 | | 10/2021 |
| WO | WO 93/02941 | | 2/1993 |
| WO | WO 93/21083 | | 10/1993 |
| WO | WO 93/25439 | A1 | 12/1993 |
| WO | WO 94/22738 | A1 | 10/1994 |
| WO | WO 95/01289 | A1 | 1/1995 |
| WO | WO 95/06604 | | 3/1995 |
| WO | WO 96/26128 | A1 | 8/1996 |

(56) References Cited

FOREIGN PATENT DOCUMENTS

| | | | |
|---|---|---|---|
| WO | WO 96/32340 | A1 | 10/1996 |
| WO | WO 2008/058294 | A1 | 5/2008 |
| WO | WO 2010/006629 | A1 | 1/2010 |
| WO | WO 2010/101852 | A1 | 9/2010 |
| WO | WO 2021/168417 | A1 | 8/2021 |
| WO | WO 2021/188751 | A1 | 9/2021 |
| WO | WO 2021/262858 | A1 | 12/2021 |

OTHER PUBLICATIONS

U.S. Appl. No. 16/426,057, filed May 30, 2019.
U.S. Appl. No. 16/426,060, filed May 30, 2019.
U.S. Appl. No. 16/426,063, filed May 30, 2019.
U.S. Appl. No. 16/426,066, filed May 30, 2019.
U.S. Appl. No. 29/692,992, filed May 30, 2019.
U.S. Appl. No. 29/692,993, filed May 30, 2019.
U.S. Appl. No. 29/692,994, filed May 30, 2019.
U.S. Appl. No. 29/692,996, filed May 30, 2019.
U.S. Appl. No. 29/692,997, filed May 30, 2019.
U.S. Appl. No. 16/598,282, filed Oct. 10, 2019.
U.S. Appl. No. 29/709,918, filed Oct. 18, 2019.
U.S. Appl. No. 16/829,346, filed Mar. 25, 2020.
U.S. Appl. No. 29/735,178, filed May 19, 2020.
U.S. Appl. No. 16/937,043, filed Jul. 23, 2020.
U.S. Appl. No. 29/739,927, filed Jun. 30, 2020.
U.S. Appl. No. 29/739,929, filed Jun. 30, 2020.
U.S. Appl. No. 29/739,931, filed Jun. 30, 2020.
U.S. Appl. No. 29/739,933, filed Jun. 30, 2020.
U.S. Appl. No. 29/739,934, filed Jun. 30, 2020.
U.S. Appl. No. 17/118,999, filed Dec. 11, 2020.
U.S. Appl. No. 17/119,016, filed Dec. 11, 2020.
U.S. Appl. No. 17/119,040, filed Dec. 11, 2020.
U.S. Appl. No. 16/562,957, filed Sep. 6, 2019.
U.S. Appl. No. 17/036,775, filed Sep. 29, 2020.
U.S. Appl. No. 17/231,368, filed Apr. 15, 2021.
U.S. Appl. No. 17/245,583, filed Apr. 30, 2021.
U.S. Appl. No. 17/478,025, filed Sep. 17, 2021.
U.S. Appl. No. 17/487,113, filed Sep. 28, 2021.
U.S. Appl. No. 17/487,262, filed Sep. 28, 2021.
U.S. Appl. No. 17/487,141, filed Sep. 28, 2021.
U.S. Appl. No. 29/775,557, filed Mar. 24, 2021.
U.S. Appl. No. 29/775,558, filed Mar. 24, 2021.
U.S. Appl. No. 29/775,559, filed Mar. 24, 2021.
U.S. Appl. No. 29/775,560, filed Mar. 24, 2021.
U.S. Appl. No. 29/818,355, filed Dec. 8, 2021.
U.S. Appl. No. 29/819,435, filed Dec. 15, 2021.
U.S. Appl. No. 29/819,437, filed Dec. 15, 2021.
U.S. Appl. No. 29/819,438, filed Dec. 15, 2021.
U.S. Appl. No. 29/819,440, filed Dec. 15, 2021; and.
U.S. Appl. No. 17/573,911, filed Jan. 12, 2022.
"Florida brewery unveils six-pack rings that spare sea turtles, not snare them," by Thomas Leavy, CBSNews.com. Date posted: May 24, 2018. Site visited: Sep. 12, 2022. Available online: https://www.cbsnews.com/news/florida-saltwater-brewery-non-plastic-six-pack-rings-spare-sea-turtles/ (Year: 2018).
"Pepsi trials molded pulp alternative to plastic rings" in BeverageDaily.com. Date posted: Feb. 28, 2020. Site visited: Sep. 12, 2022. Available online: https://www.beveragedaily.com/Article/2020/02/28/Pepsi-trials-molded-pulp-alternative-to-plastic-rings# (Year: 2020).
Enviroclip. Date posted: 2022. Site visited: Sep. 12, 2022. Available online: https://www.graphicpkg.com/products/enviroclip/ (Year: 2022).
"Paperboard Can Handle Applicator," as seen in Packaging World Online. Date first available: 2020. Site visited: Sep. 13, 2022. Available online: https://www.packworld.com/news/sustainability/article/21202650/paperboard-can-handle-applicator (Year: 2020).
"The 'ECOGRIP' Corrugated Bottle Carrier is a Plastic Alternative" in Trendhunter.com. Date published: Jan. 20, 2021. Site visited: Sep. 12, 2022. Available online: https://www.trendhunter.com/trends/corrugated-bottle-carrier (Year: 2021).
Cap-it packaging video on Vimeo. Date posted: 2021. Site visited: Sep. 19, 2022. Available online: https://vimeo.com/610619455?embedded=true&source=vimeo_logo&owner=24551687 (Year: 2021).
2020 Package of the Year and Innovation of the Year on YouTube. Date posted: Oct. 19, 2020. Site visited: Sep. 12, 2022. Available online: https://www.youtube.com/watch?v=wxwpM4hodFA (Year: 2020).

CARRIER FOR CONTAINERS

CROSS-REFERENCE TO RELATED APPLICATIONS

This application claims the benefit of each of U.S. Provisional Patent Application No. 63/085,365, filed on Sep. 30, 2020, U.S. Provisional Patent Application No. 63/086,681, filed on Oct. 2, 2020, U.S. Provisional Patent Application No. 63/120,863, filed on Dec. 3, 2020, U.S. Provisional Patent Application No. 63/136,400, filed on Jan. 12, 2021, and U.S. Provisional Patent Application No. 63/208,646, filed on Jun. 9, 2021.

INCORPORATION BY REFERENCE

The disclosures of each of U.S. Provisional Patent Application No. 62/779,689, filed on Dec. 14, 2018, U.S. Provisional Patent Application No. 62/783,752, filed on Dec. 21, 2018, U.S. Provisional Patent Application No. 62/796,830, filed on Jan. 25, 2019, U.S. Provisional Patent Application No. 62/797,585, filed on Jan. 28, 2019, U.S. Provisional Patent Application No. 62/810,015, filed on Feb. 25, 2019, U.S. Provisional Patent Application No. 62/814,412, filed on Mar. 6, 2019, U.S. Provisional Patent Application No. 62/817,120, filed on Mar. 12, 2019, U.S. Provisional Patent Application No. 62/84630227571,449, filed on May 1, 2019, U.S. patent application Ser. No. 16/426,050, filed on May 30, 2019, U.S. patent application Ser. No. 16/426,057, filed on May 30, 2019, U.S. patent application Ser. No. 16/426,060, filed on May 30, 2019, U.S. patent application Ser. No. 16/426,063, filed on May 30, 2019, U.S. patent application Ser. No. 16/426,066, filed on May 30, 2019, U.S. Design Pat. Application No. 29/692,992, filed on May 30, 2019, U.S. Design Pat. Application No. 29/692,993, filed on May 30, 2019, U.S. Design Pat. Application No. 29/692,994, filed on May 30, 2019, U.S. Design Pat. Application No. 29/692,996, filed on May 30, 2019, U.S. Design Pat. Application No. 29/692,997, filed on May 30, 2019, U.S. patent application Ser. No. 16/598,282, filed on Oct. 10, 2019, U.S. Design Pat. Application No. 29/709,918, filed on Oct. 18, 2019, U.S. Provisional Patent Application No. 62/952,839, filed on Dec. 23, 2019, U.S. Provisional Patent Application No. 62/956,882, filed on Jan. 3, 2020, U.S. Provisional Patent Application No. 62/985,997, filed on Mar. 6, 2020, U.S. patent application Ser. No. 16/829,346, filed on Mar. 25, 2020, and U.S. Provisional Patent Application No. 63/015,898, filed on Apr. 27, 2020, U.S. Provisional Patent Application No. 63/022,757, filed on May 11, 2020, U.S. Provisional Patent Application No. 63/023,442, filed on May 12, 2020, U.S. Design Pat. Application No. 29/735,178, filed on May 19, 2020, U.S. Provisional Patent Application No. 63/031,615, filed on May 29, 2020, U.S. Design Pat. Application No. 29/739,927, filed on Jun. 30, 2020, U.S. Design Pat. Application No. 29/739,929, filed on Jun. 30, 2020, U.S. Design Pat. Application No. 29/739,931, filed on Jun. 30, 2020, U.S. Design Pat. Application No. 29/739,933, filed on Jun. 30, 2020, U.S. Design Pat. Application No. 29/739,934, filed on Jun. 30, 2020, U.S. Provisional Patent Application No. 63/085,365, filed on Sep. 30, 2020, U.S. Provisional Patent Application No. 63/086,681, filed on Oct. 2, 2020, U.S. Provisional Patent Application No. 63/120,863, filed on Dec. 3, 2020, U.S. patent application Ser. No. 17/119,040, filed on Dec. 11, 2020, U.S. patent application Ser. No. 17/118,999, filed on Dec. 11, 2020, U.S. Provisional Patent Application No. 63/136,400, filed on Jan. 12, 2021, U.S. Design Pat. Application No. 29/775,557, filed on Mar. 24, 2021, U.S. Design Pat. Application No. 29/775,558, filed on Mar. 24, 2021, U.S. Design Pat. Application No. 29/775,559, filed on Mar. 24, 2021, U.S. Design Pat. Application No. 29/775,560, filed on Mar. 24, 2021, U.S. Provisional Patent Application No. 63/208,568, filed on Jun. 9, 2021, and U.S. Provisional Patent Application No. 63/208,646, filed on Jun. 9, 2021, U.S. Provisional Application No. 62/728,454, filed on Sep. 7, 2018, U.S. Provisional Patent Application No. 62/767,188, filed on Nov. 14, 2018, U.S. Provisional Patent Application No. 62/770,566, filed on Nov. 21, 2018, and U.S. Provisional Patent Application No. 63/214,868, filed on Jun. 25, 2021, U.S. Provisional Patent Application No. 63/216,062, filed on Jun. 29, 2021, and U.S. Provisional Patent Application No. 63/219,648, file d on Jul. 8, 2021, U.S. Provisional Patent Application No. 63/222,225, filed on Jul. 15, 2021, U.S. Provisional Patent Application No. 63/203,882, filed on Aug. 3, 2021, U.S. Provisional Patent Application No. 63/260,881, filed on Sep. 3, 2021, and U.S. Provisional Patent Application No. 63/261,582, filed on Sep. 24, 2021, are hereby incorporated by reference for all purposes as if presented herein in their entirety. The disclosures of each of U.S. Pat. No. 8,387,784, issued on Mar. 5, 2013, U.S. Pat. No. 8,096,413, issued on Jan. 17, 2012, and U.S. Pat. No. 11,027,905, issued on Jun. 8, 2021, are also hereby incorporated by reference for all purposes as if presented herein in their entirety.

BACKGROUND OF THE DISCLOSURE

The present disclosure generally relates to cartons or carriers for holding, displaying, and/or transporting containers.

SUMMARY OF THE DISCLOSURE

According to one aspect, the disclosure is generally directed to a carrier for holding a plurality of containers, the carrier comprising a top panel comprising a plurality of container retention openings for at least partially receiving a respective container of the plurality of containers, at least one container retention flap foldably connected to the top panel at a fold line, and at least one reinforcement panel interrupting the fold line and positioned between the top panel and the at least one container retention flap.

According to another aspect, the disclosure is generally directed to a blank for forming a carrier for holding a plurality of containers, the blank comprising a top panel comprising a plurality of container retention openings for at least partially receiving a respective container of the plurality of containers when the carrier is formed from the blank, at least one container retention flap foldably connected to the top panel at a fold line, and at least one reinforcement panel interrupting the fold line and positioned between the top panel and the at least one container retention flap.

According to another aspect, the disclosure is generally directed to a method of forming a carrier for holding a plurality of containers, the method comprising obtaining a blank comprising a top panel comprising a plurality of container retention openings, at least one container retention flap foldably connected to the top panel at a fold line, and at least one reinforcement panel interrupting the fold line and positioned between the top panel and the at least one container retention flap, and positioning the blank such that the plurality of container retention openings is positioned for at least partially receiving a respective container of the plurality of containers.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Carriers according to the present disclosure can accommodate containers of numerous different shapes. For the purpose of illustration and not for the purpose of limiting the scope of the disclosure, the following detailed description describes beverage containers (e.g., aluminum cans) at least partially disposed within the carrier embodiments. In this specification, the terms "lower," "bottom," "upper," "top," "front," and "back" indicate orientations determined in relation to fully erected carriers.

As described herein, carriers may be formed by multiple overlapping panels, end flaps, and/or other portions of blanks. Such panels, end flaps, and/or other portions of the blank can be designated in relative terms to one another, e.g., "first", "second", "third", etc., in sequential or non-sequential reference, without departing from the disclosure.

Figure 1:
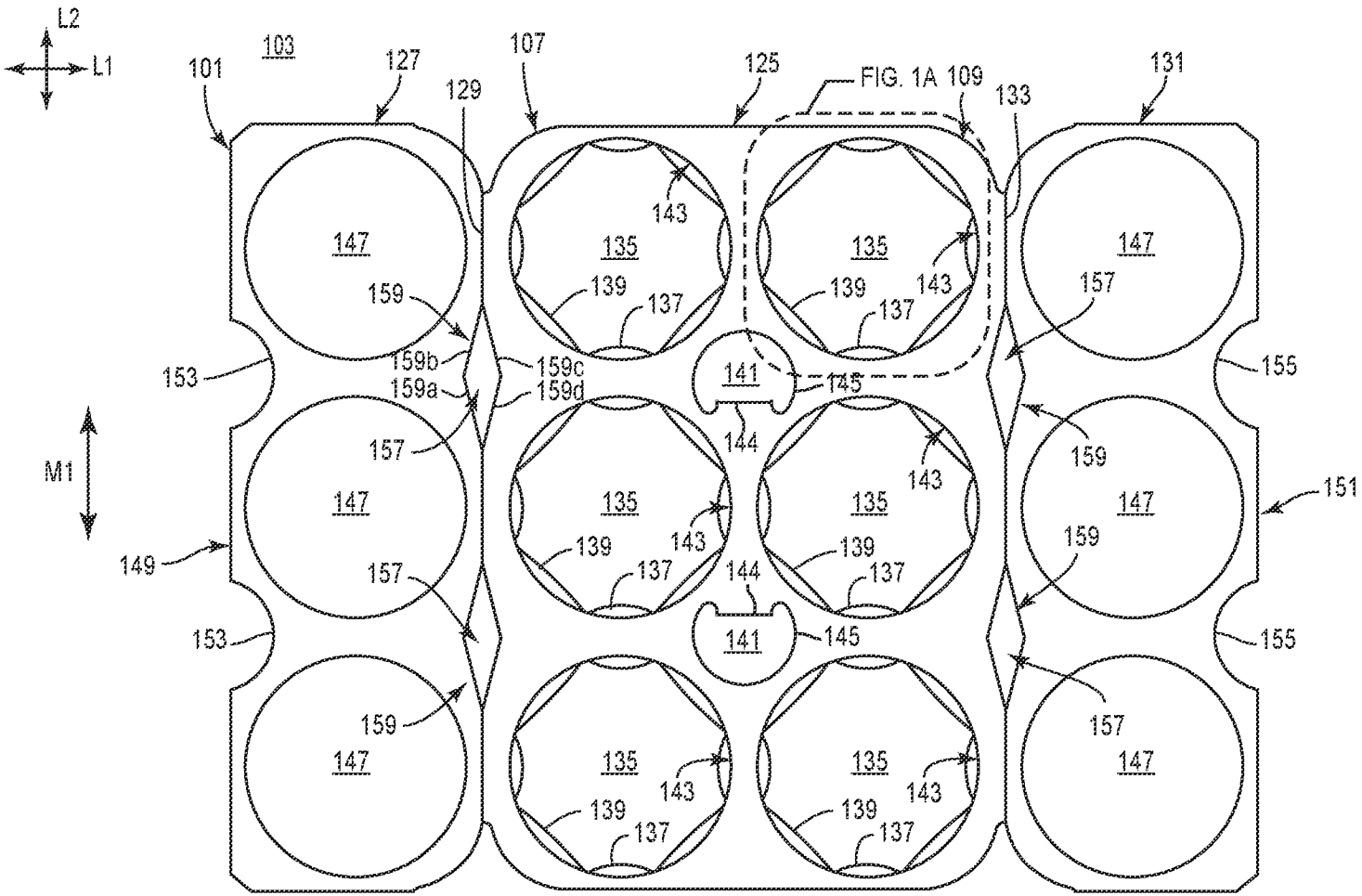
FIG. 1 is a plan view of an outer surface of a blank for forming a carrier according to a first exemplary embodiment of the disclosure.
Figure 2:
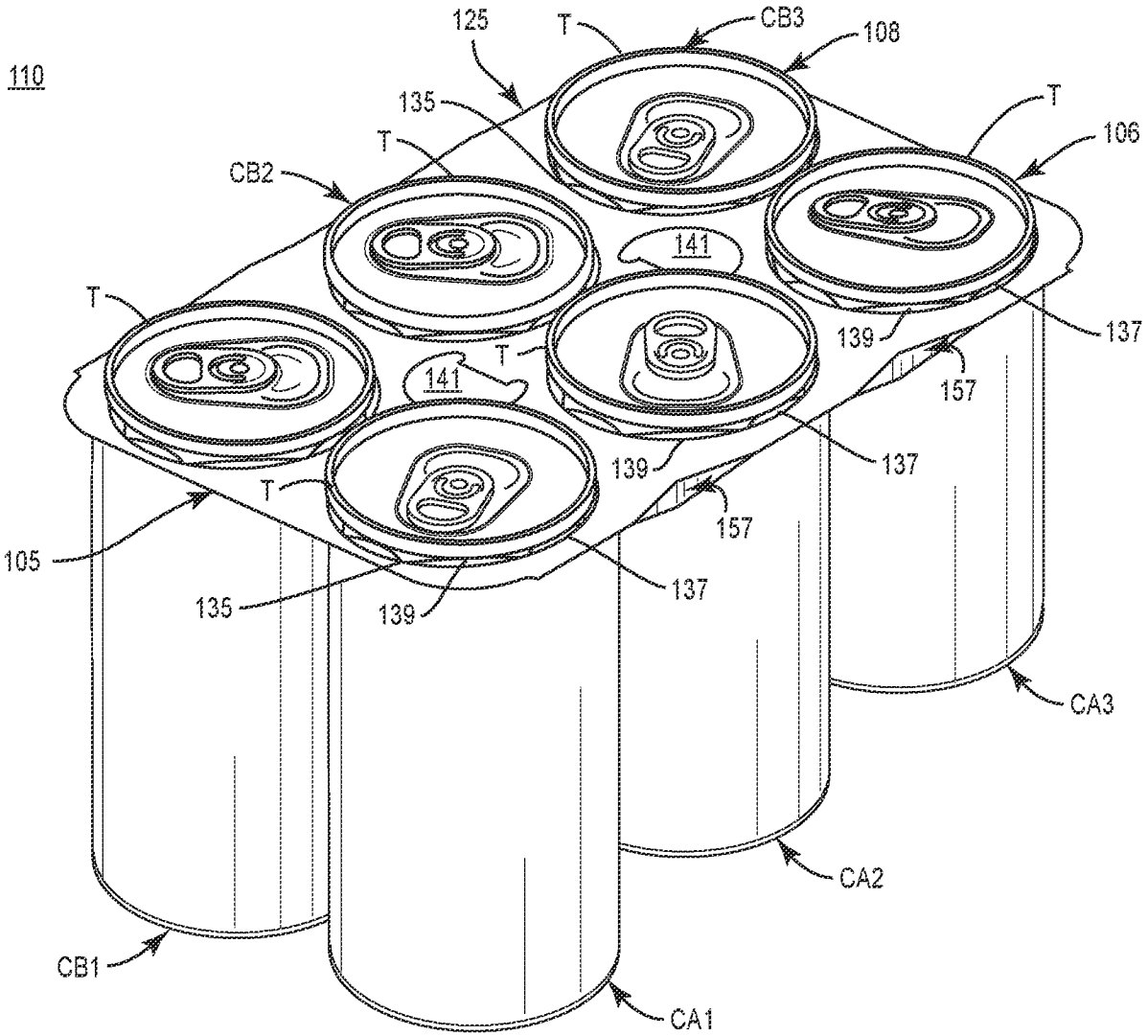
FIG. 2 is perspective view of a package including a carrier formed from the blank of FIG. 1 and a plurality of containers according to the first exemplary embodiment of the disclosure.

FIG. 1 shows a plan view of an exterior side 101 of a blank 103 used to form a carrier 105 (FIG. 2) in accordance with a first exemplary embodiment of the disclosure. As described further herein, the carrier 105 can be configured for holding/supporting/retaining/receiving a plurality of containers. The carrier 105 can be provided with one or more containers to form a package 110 (FIG. 2).

Containers suitable for use with the carriers of the present disclosure can be beverage cans having a lower base portion, a top portion T generally comprising a neck that tapers inwardly from the lower base portion, a flange portion at the top of the neck portion that extends radially outward from the neck portion, and a top surface below the flange portion that includes a pull-tab. Containers of other sizes, shapes, and configurations, may be held in the carriers without departing from the disclosure.

Still referring to FIG. 1, the carrier 105 can be sized to contain or support six containers, with three containers CA1, CA2, CA3 being attached to a front portion 106 of the carrier 105 and three containers CB1, CB2, CB3 being attached to a back portion 108 of the carrier 105. In the illustrated embodiment, the containers CA1, CA2, CA3, CB1, CB2, CB3 can be beverage cans, or could be any other suitable type and size of container without departing from the disclosure. The carrier 105 can be provided together with one or more of the containers as a package 110.

The carrier 105 can be sized and shaped to hold more or less than six containers. In one embodiment, the front portion 106 and the back portion 108 of the carrier 105 each have three containers, and in other embodiments, the front portion 106 and the back portion 108 of the carrier 105 can carry more or less than three containers without departing from the disclosure.

As shown in FIG. 1, the blank 103 has a longitudinal axis L1 and a lateral axis L2. The blank 103 has a front portion 107 for forming the front portion 106 of the carrier 105 and a back portion 109 for forming the back portion 108 of the carrier 105.

In the illustrated embodiment, the blank 103 comprises a top panel 125 (broadly, "first top panel" or "central panel" or "attachment panel"), a container retention flap 127 (broadly, "first container retention flap", "first top end flap", "second top panel", or "first container retention panel") foldably connected to the top panel 125 at a lateral fold line 129 (broadly, "first fold line"), and a container retention flap 131 (broadly, "second container retention flap", "second top flap", "third top panel", or "second container retention panel") foldably connected to the top panel 125 at a lateral fold line 133 (broadly, "second fold line").

Figure 1A:
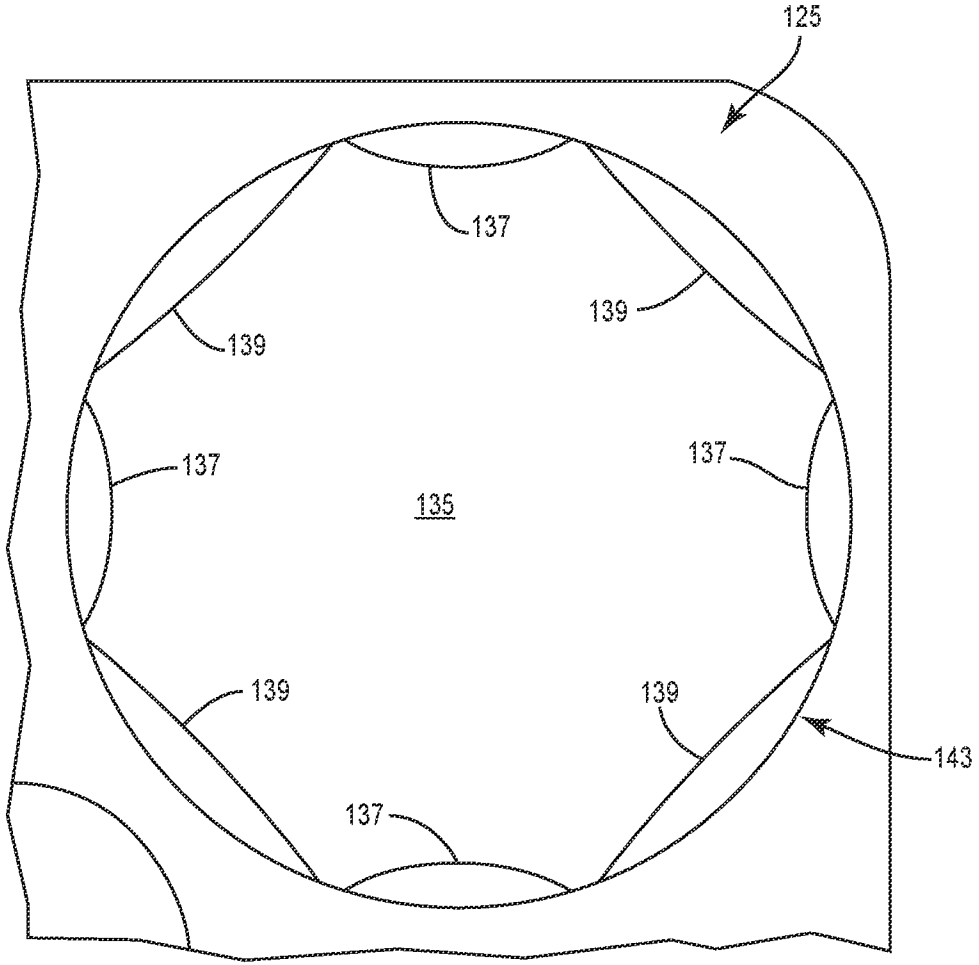
FIG. 1A is an enlarged view of a portion of the blank of FIG. 1.

With additional reference to FIG. 1A, the top panel 125 can have container retention features that include a plurality of container retention openings 135 (broadly, "first plurality of container retention openings"). As shown, the container retention openings 135 can be provided in a column and row arrangement in a number that corresponds to a desired number of containers to be held by the carrier 105 formed from the blank 103. While the top panel 125 is shown having container openings 135 provided in two rows/columns of three openings 135 each, it will be understood that a different number and/or arrangement of container retention openings 135 can be provided without departing from the disclosure.

As shown in FIG. 1A, the container retention openings 135 can have a generally circular configuration, with container retention tabs 137, 139 provided in an alternating arrangement foldably connected to the top panel 125 at respective portions of a curved fold line/line of weakening 143. In the illustrated arrangement, a pair of diametrically opposed container retention tabs 137 are provided along a line parallel with the longitudinal axis L1, a pair of diametrically opposed container retention tabs 137 are provided along a line parallel with the lateral axis L2, and container retention tabs 139 are provided between respective adjacent container retention tabs 137 at respective oblique angles relative to the axes L1, L2. It will be understood that the container retention tabs 137, 139 can be provided in a generally abutting circumferential arrangement, though spacing could be provided between adjacent container retention tabs without departing from the disclosure.

While the container retention tabs 137, 139 are illustrated as having generally curved free edges facing the interior of the container retention opening 135, and with the container retention tabs 137 larger than the container retention tabs 139, it will be understood that one or more of the container retention tabs 137, 139 can have a different configuration or arrangement without departing from the disclosure. In one embodiment, the container retention tabs 137, 139 can be foldably connected to the top panel 125 at respective curved fold lines. In another embodiment, the container retention tabs 137, 139 can be foldably connected to the top panel 125 at respective portions of a curved fold line spanning multiple container retention tabs 137, 139.

The blank 103/carrier 105 can also have handle features that include at least one handle tab 141 foldably connected to the top panel 125 at a longitudinal fold line 144 and at least partially defined by a curved cut 145 extending from one endpoint of the fold line 144 to the other endpoint of the fold line 144. As described further herein, the handle tabs 141 can be separated from the top panel 125 to form respective handle openings for user engagement of the carrier 105.

Still referring to FIG. 1, each of the container retention flaps 127, 131 includes respective container retention openings 147 (broadly, "second plurality of container retention openings"). The container retention openings 147 are for being aligned with the respective container retention openings 135 when the carrier 105 is formed from the blank 103, as described further herein. While the container retention openings 147 are illustrated as generally symmetrical circular apertures, it will be understood that one or more of the container retention openings 147 can have a different configuration without departing from the disclosure, e.g., having multiple foci and/or asymmetrical portions, etc.

As also shown, the container retention flaps 127, 131 have respective lateral free edges 149, 151 that define respective recessed portions 153, 155. As described further herein, when the carrier 105 is formed from the blank 103, the recessed portions 153, 155 are positionable to abut and/or at least partially surround a respective handle tab 141 to provide clearance and/or reinforcement for user engagement of the carrier 105. In this regard, the recessed portions 153, 155 can also form handle features of the blank 103/carrier 105.

With continued reference to FIG. 1, the blank 103/carrier 105 formed therefrom can be configured to stiffen/inhibit relative movement of portions of the blank 103/carrier 105 when in use. As shown, a pair of laterally-spaced reinforcement features/reinforcement panels 157 (broadly, "first reinforcement feature/reinforcement panel") can be positioned interrupting the fold line 129. Each reinforcement feature/panel 157, as shown, can be a region of the blank 103/carrier 105 between the top panel 125 and the container retention flap 127 and that is defined by a line of weakening 159 extending between endpoints of segments of the fold line 129.

The line of weakening 159, as shown, can include a plurality of intersecting oblique segments 159*a*, 159*b*, 159*c*, 159*d*. In the illustrated embodiment, each of the segments 159*a*, 159*b*, 159*c*, 159*d* can be arranged so as to form a generally rhomboid/diamond-shaped reinforcement feature/panel 157. In one embodiment, each of the segments 159*a*, 159*b*, 159*c*, 159*d* of the line of weakening 159 can be arranged at an angle of about 45° relative to each of the axes L1, L2. In other embodiments, one or more of the segments of the line of weakening 159 can be arranged at a different angle relative to the axes L1, L2. It will be understood that one or more of the lines of weakening 159/reinforcement panels 157 can have one or more different features, e.g., curved and/or longitudinal/lateral portions, without departing from the disclosure.

As shown, a pair of longitudinally-spaced reinforcement features/reinforcement panels 157 (broadly, "second reinforcement feature/panel") can also be provided interrupting the fold line 133 so as to be positioned between the top panel 125 and the container retention flap 131. It will be understood that a different number and/or arrangement of the reinforcement panels 157 can be provided without departing from the disclosure.

Any of the panels, flaps, fold lines, cuts, or other features could be otherwise shaped, arranged, and/or omitted from the blank 103 without departing from the disclosure. The blank 103 could be sized and/or shaped to accommodate more or less than six containers without departing from this disclosure.

With additional reference to FIG. 2, according to one exemplary embodiment of forming the carrier 105/package 110, the blank 103 can be positioned above a group of containers and the container retention flaps 127, 131 can be folded toward the interior surfaced/underside of the blank 103 at the respective fold lines 129, 133 such that the container retention openings 147 of the respective container retention flaps 127, 131 align with the respective container retention openings 135 of the top panel 125.

In such an arrangement, the blank 103 can be lowered upon the containers CA1, CA2, CA3, CB1, CB2, CB3 such that upper or top portions T of the respective containers CA1, CA2, CA3 can be at least partially received through the respective aligned container retention openings 135, 147.

Accordingly, the edge of the container retention flaps 127, 131 surrounding the respective container retention openings 147 at least partially receive a top portion T of the respective containers, e.g., a rolled rim of the respective containers, and the container retention openings 135 subsequently receive the respective top portions T of the respective containers.

Such movement of the respective top portions T of the respective containers through the respective container retention openings 135 can cause the container retention tabs 137, 139 to be urged upwardly at the respective portions of the fold line 143 so as to extend at least partially upwardly relative to the top panel 125. In this regard, the container retention tabs 137, 139 can extend from the top panel 125 to contact a respective container at the neck portion thereof below a respective flange. Such upward/oblique arrangement of the container retention tabs 137, 139 extending from the top panel 125 to a top structure of the respective containers can provide a reinforced, braced, stabilized, etc. engagement of the blank 103/carrier 105 with the containers.

Furthermore, the overlapping relationship of respective portions of the top panel 125 with the container retention flaps 127, 131 is such that the container retention flaps 127, 131 provide an underlying support or shelf-like feature that can minimize/resist bending, buckling, flexion, torsion, etc. and provide a stable platform from which the top panel 125 and container retention tabs 137, 139 extending upwardly therefrom are supported.

In addition to the support provided by the 2-ply/overlapping engagement of the top panel 125 with the container retention flaps 127, 131, the reinforcement panels 157 are presented in an outward-facing arrangement relative to the top panel 125 and the container retention flaps 127, 131 so as to form a generally upright/vertical structure (e.g., relative to the top panel 125) that further minimizes/resists bending, buckling, flexion, torsion, etc. of the carrier 105/package 110 relative to a plane defined by the top panel 125 and/or the container retention flaps 127, 131, e.g., such that the carrier 105/package 110 minimizes/resists such forces/movement along both the longitudinal axis L1 and the lateral axis L2. In this regard, the reinforcement panels 157 are positioned between the top panel 125 and the respective container retention flaps 127, 131.

Still referring to FIG. 2, the package 110/carrier 105 can be grasped by a consumer by separating one or both handle tabs 141 from the top panel at the respective cuts 145 and folding the handle tab 141 downwardly at the respective fold line 144 to form a respective handle opening in the top panel 125 through which the user can insert one or more of his or her fingers. As described above, the recessed portions 153, 155 of the respective container retention flaps 127, 131 can be positioned abutting/surrounding the respective handle openings such that a user can engage the underside of the respective container retention flaps 127, 131 and/or a portion of the top panel 125, e.g., adjacent the respective recessed portion 153, 155, in order to engage and lift/carry or otherwise move the carrier 105/package 110.

In addition, the oblique arrangement of the container retention tabs 139 relative to the handle tabs 141/openings formed therefrom enhances the resistance to bending, buckling, flexion, torsion, etc. of the top panel 125 and/or respective portions of the container retention flaps 127, 131 along both the longitudinal axis L1 and the lateral axis L2 when forces are exerted on the carrier 105/package 110 in the course of lifting, carrying, or otherwise moving the carrier 105/package 110 via engagement of the handle features by a user.

Furthermore, upon formation of the package 110/carrier 105 respective containers CA1, CA2, CA3, CB1, CB2, CB3 can be removed from the carrier 105 by disengaging the respective container from the top panel 125 and respective container retention flap 127, 131, for example, by moving the respective container retention tabs 137, 139 away from the neck portion of a respective container and withdrawing the top portion T of a respective container through respective aligned container retention openings 135, 147.

It will be understood that the carrier 105/package 110 can have a different configuration without departing from the disclosure.

Figure 3:
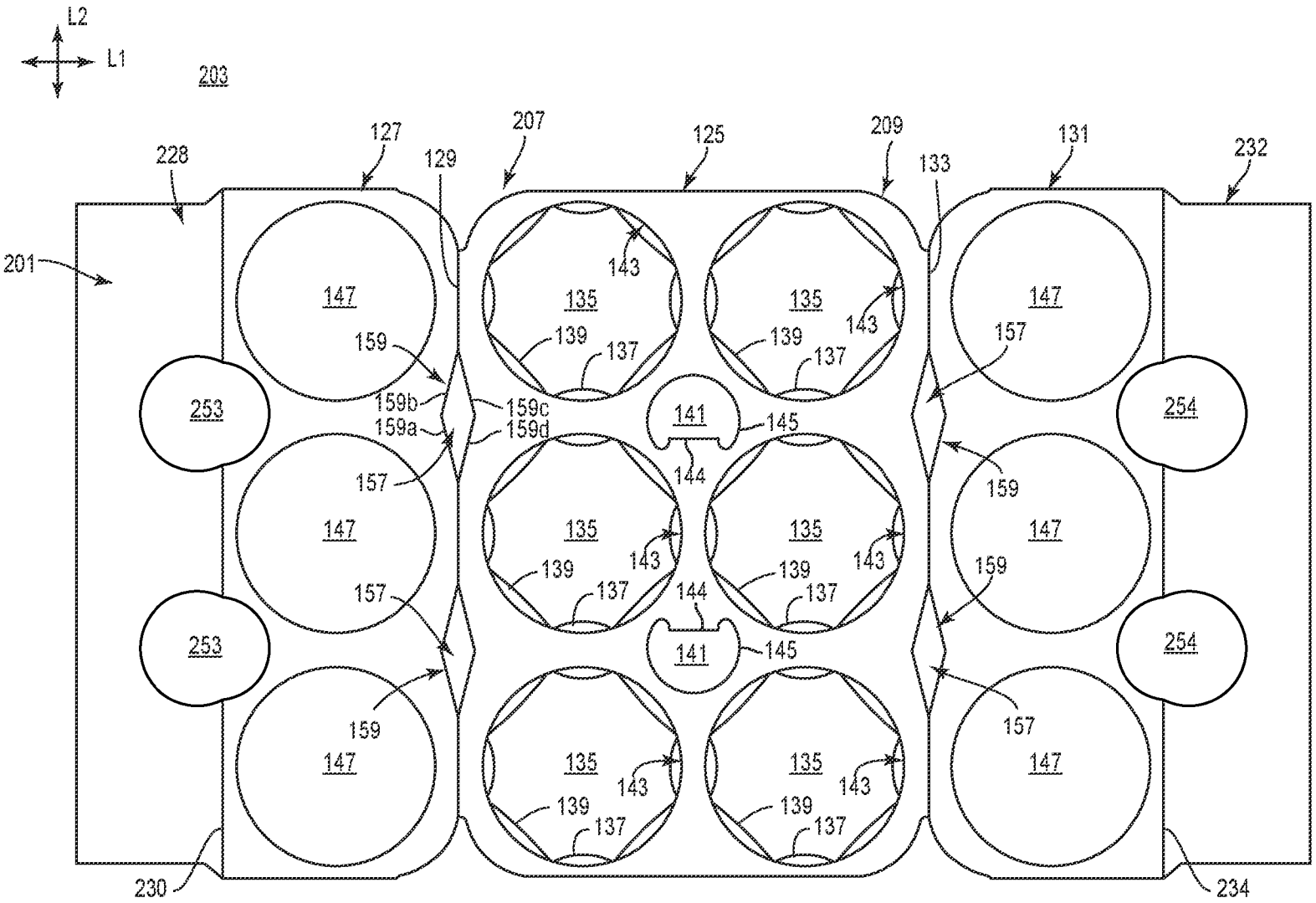
FIG. 3 is a plan view of an exterior surface of a blank for forming a carrier according to a second exemplary embodiment of the disclosure.

Referring to FIG. 3, a plan view of an exterior surface 201 of a blank 203 for at least partially forming a carrier 205 (FIG. 4) is illustrated according to a second exemplary embodiment of the disclosure. The carrier 205 formed from the blank 203 can be provided with one or more containers to form a package 210.

The blank 203 includes a front portion 207 for forming a front portion 206 of the carrier 205 and the blank 203 includes a back portion 209 for forming a back portion 208 of the carrier 205. The blank 203 and carrier 205 can have one or more features that are substantially similar to those described above with regard to the blank 103 and carrier 105/package 110, and like or similar features are identified with like or similar reference numerals.

As shown, the blank 203 is substantially similar to the blank 103 with the exception that the blank 203 further includes a first reinforcement flap 228 (broadly, "first central panel" or "first keel") foldably connected to the container retention flap 127 at a lateral fold line 230 and a second reinforcement flap 232 (broadly, "second central panel" or "second keel") foldably connected to the container retention flap 131 at a lateral fold line 234.

Furthermore, the handle features of the blank 203/carrier 205 can include handle apertures 253, 254 that interrupt the respective fold lines 230, 234 and are for at least partially aligning with the respective handle tabs 141 when the carrier 205 is formed from the blank 203. As shown, portions of the respective handle apertures 253, 254 can correspond to the respective recessed portions 153, 154 of the blank 103 described above. The blank 203/carrier 205 can have one or more different handle features without departing from the disclosure.

Figure 4:
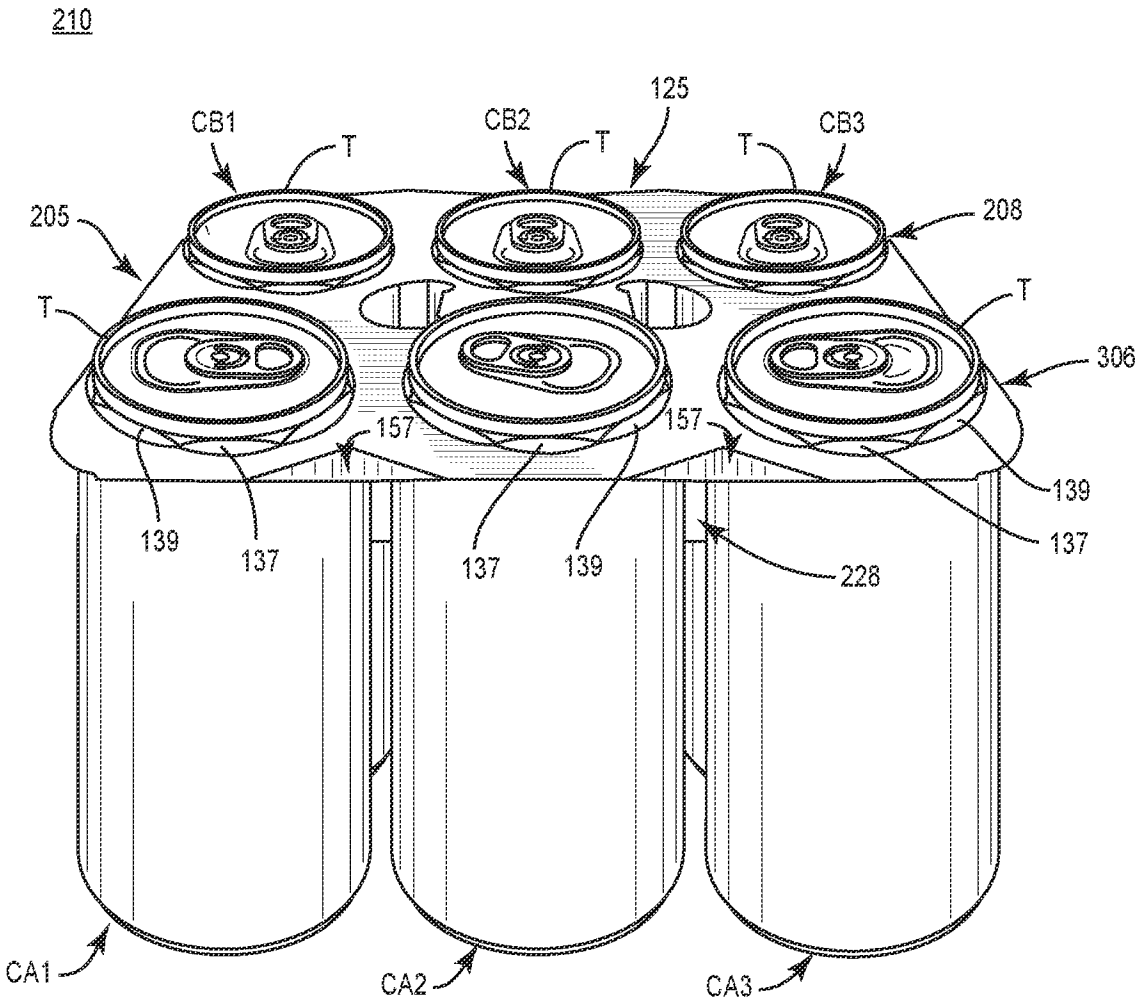
FIG. 4 is perspective view of a package including a carrier formed from the blank of FIG. 3 and a plurality of containers according to the second exemplary embodiment of the disclosure.
Figure 5:
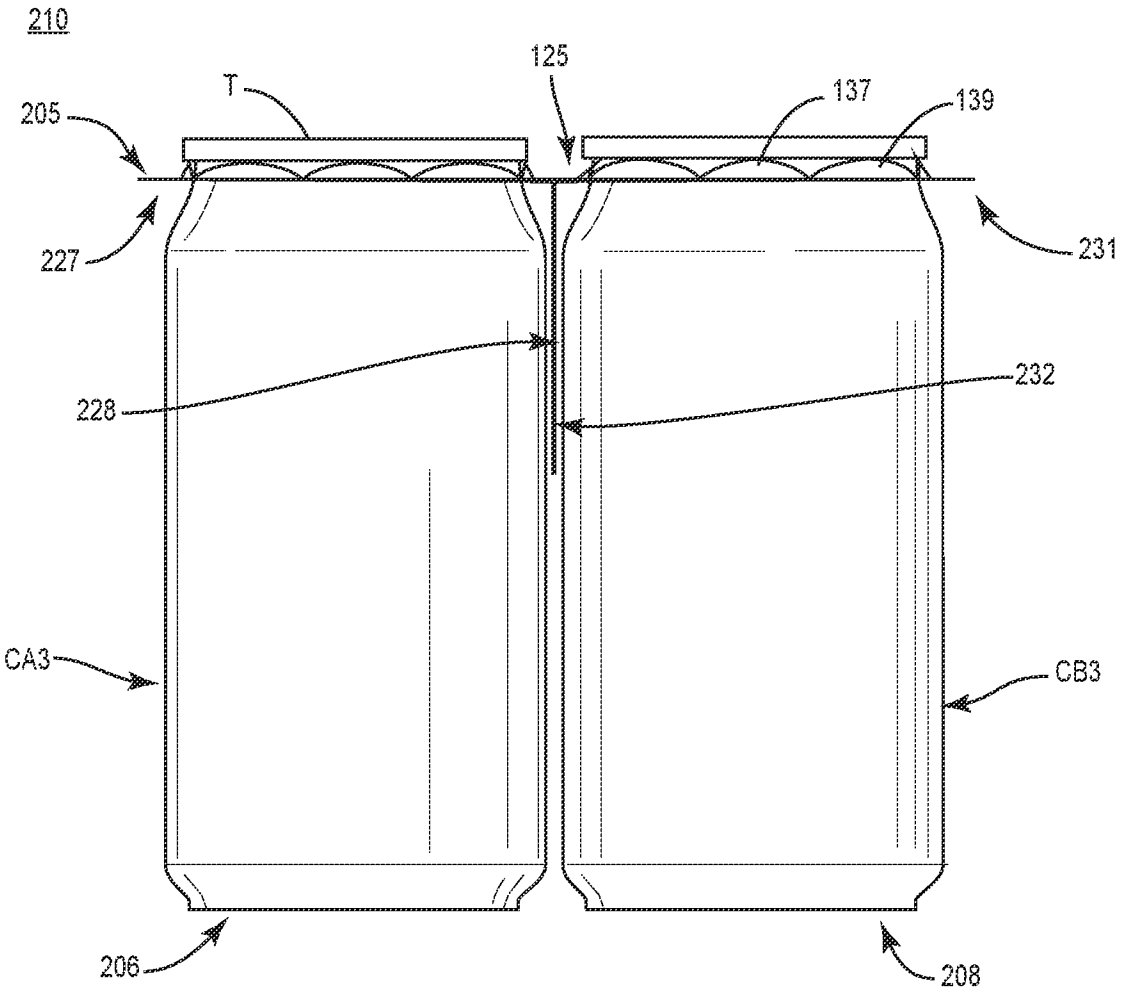
FIG. 5 is a side view of the package of FIG. 4.

With additional reference to FIGS. 4 and 5, the carrier 205/package 210 can be formed in a manner similar to the carrier 105 and package 110 described above such that the front portion 206 of the carrier 205 can hold up to three containers CAL CA2, CA3 and such that the back portion 208 of the carrier 305 can hold up to three containers CB1, CB2, CB3.

Furthermore, the reinforcement flaps 228, 232 can be folded at the respective fold lines 230, 234 into at least partial face-to-face contact with one another and positioned extending downwardly from the top panel 125 and container retention flaps 127, 131 between the containers CAL CA2, CA3 in the front portion 206 of the carrier 205/package 210 and the containers CB1, CB2, CB3 in the back portion 208 of the carrier 205/package 210. It will be understood that the reinforcement flaps 228, 232 can provide a divider/separator/buffer between the containers CAL CA2, CA3 in the front portion 206 of the carrier 205/package 210 and the containers CB1, CB2, CB3 in the back portion 208 of the carrier 205/package 210.

The vertical positioning of the reinforcement flaps 228, 232 at the center of the carrier 205/package 210 is such that additional resistance to bending, buckling, flexion, torsion, etc. of the carrier 205/package 210 relative to a plane defined by the top panel 125 and/or the container retention flaps 127, 131 is provided, e.g., such that the carrier 205/package 210 minimizes/resists such forces/movement along both the longitudinal axis L1 and the lateral axis L2.

Furthermore, the arrangement of the handle apertures 253, 254 is such that, when the reinforcement flaps 228, 232 are extending downwardly from the container retention flaps 127, 131, portions of the apertures 253, 254 extending into the reinforcement flaps 228, 232 are positioned to provide clearance for one or more of a user's fingers extending through the handle openings formed by the handle tabs 141.

The carrier 205/package 210 can provide advantages that are the same or similar to those described above with respect to the carrier 105 and package 110, e.g., the container retention features and reinforcement panels thereof.

Figure 6:
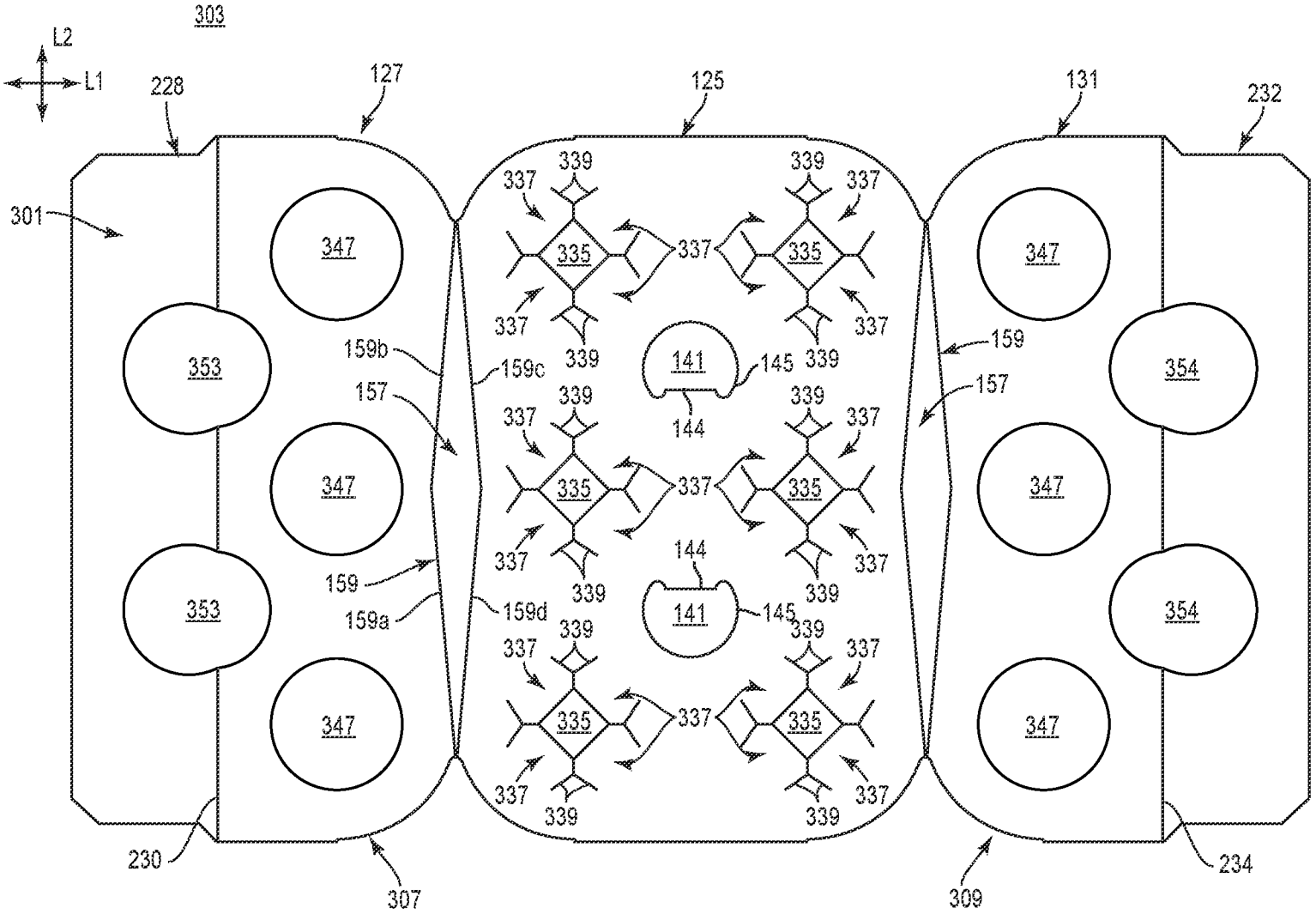
FIG. 6 is a plan view of an exterior surface of a blank for forming a carrier according to a third exemplary embodiment of the disclosure.

Referring to FIG. 6, an exterior surface 301 of a blank 303 for forming a carrier 305 and package 310 (FIG. 7) according to a third exemplary embodiment of the disclosure is illustrated. The blank 303 and the carrier 305/package 310 formed therefrom can have one or more features that are substantially similar to those described above with regard to the blanks 103, 203, carriers 105, 205, and packages 110, 210 described above, and like or similar features are identified with like or similar reference numerals.

As shown, the blank 303 can have the longitudinal axis L1 and the lateral axis L2, a front portion 306 for carrying up to three containers CAL CA2, CA3 and aback portion 308 for carrying up to three containers CB1, CB2, CB3. In the illustrated embodiment, the blank 303 can include the top panel 125, the container retention flaps 127, 131, the reinforcement flaps 228, 232, and associated features. In the illustrated embodiment, a single elongated reinforcement feature/panel 157 can be provided interrupting the respective fold lines 128, 133, through a different number and/or arrangement of reinforcement features/panels 157 can be provided without departing from the disclosure.

As described herein, the blank 303 can be formed into the carrier 305/package 310 for holding one or more containers in the form of bottles, e.g., plastic bottles formed of polyethylene terephthalate (PET) or another polymer, and having upper portions that include a flange F supporting a cap CP.

In this regard, container retention openings 335 (broadly, "first plurality of container retention openings") in the top panel 125 and container retention openings 347 in the container retention flaps 127, 131 (broadly, "second plurality of container retention openings") can be sized and configured to receive and engage the upper portion of the respective containers. The blank 303/carrier 305/package 310 can further be provided with container retention tabs 337 formed by respective cuts 339 having one or more of curved, straight, and angled portions. The container retention tabs 337, as shown, can be provided in diametrically opposed pairs extending into the respective container retention openings 335 and having generally tapered trapezoidal configuration with beveled edges, though one or more of the container retention tabs 337 can have a different configuration without departing from the disclosure.

Figure 7:
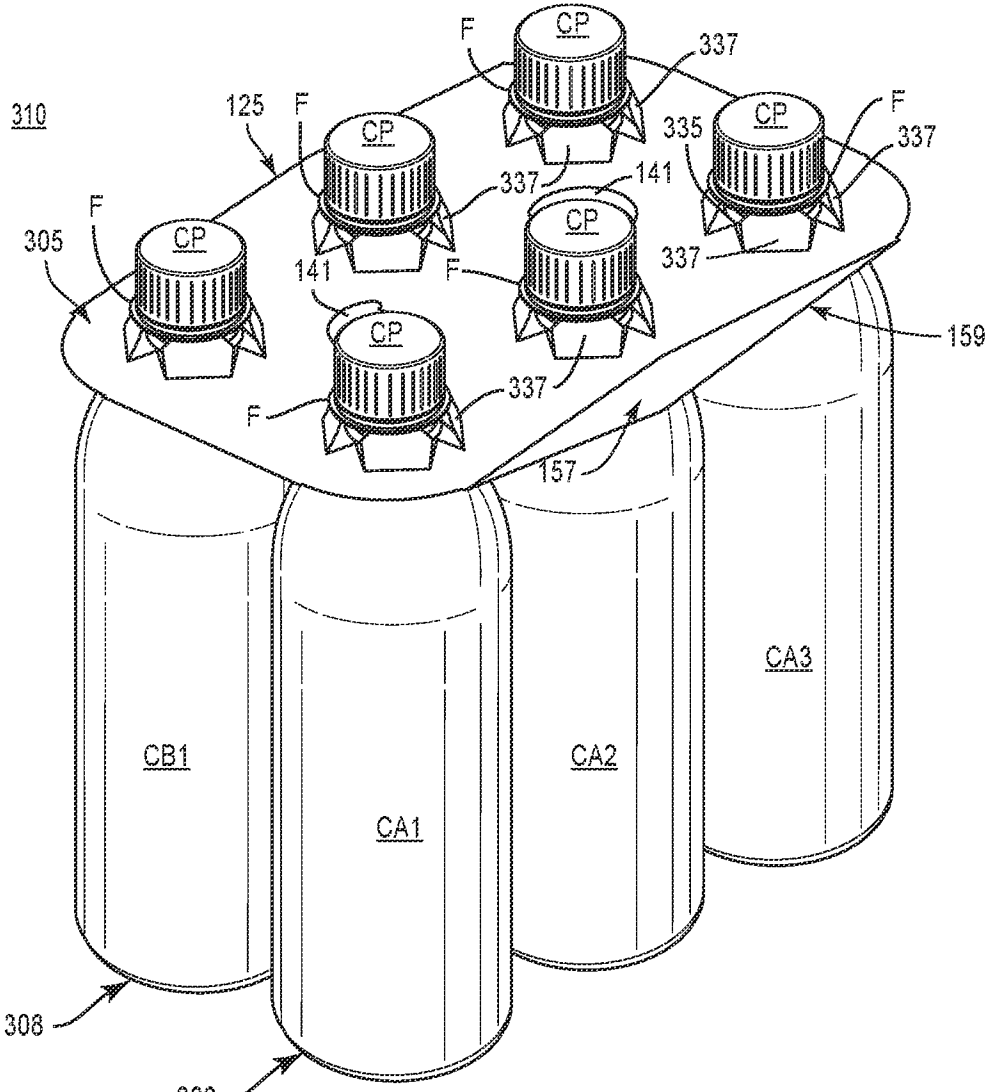
FIG. 7 is perspective view of a package including a carrier formed from the blank of FIG. 6 and a plurality of containers according to the third exemplary embodiment of the disclosure.

With additional reference to FIG. 7, the carrier 305/package 310 can be formed in a manner substantially similar manner to that described above with regard to the carriers 105, 205/packages 110, 210 with the container retention flaps 127, 131 folded under the top panel 125 such that the aligned container retention openings 335, 347 are aligned to at least partially receive upper portions of the respective containers CAL CA2, CA3, CB1, CB2, CB3, e.g., portions surrounding the respective caps CP and respective flanges F therethrough, with the container retention tabs 337 positioned to extend from the top panel 125 to contact a respective container at a neck portion thereof below a respective flange F.

Furthermore, the reinforcement flaps 228, 232 can be positioned in at least partial face-to-face contact with one another and positioned extending downwardly from the top panel 125 and container retention flaps 127, 131 between the containers CAL CA2, CA3 in the front portion 306 of the carrier 305/package 310 and the containers CB1, CB2, CB3 in the back portion 308 of the carrier 305/package 310 as described above with regard to the carrier 205/package 210.

The carrier 305/package 310 can provide advantages that are the same or similar to those described above with respect to the carriers 105, 205 and packages 110, 210 described above, e.g., the container retention features and reinforcement panels. It will be understood that the carrier 305/package 310 can have a different configuration without departing from the disclosure.

Referring to FIG. 7, a plan view of an exterior surface 401 of an upper blank 403 (broadly, "second blank") for at least partially forming a carrier 405 (FIG. 10) is illustrated according to a fourth exemplary embodiment of the disclosure.

Figure 10:
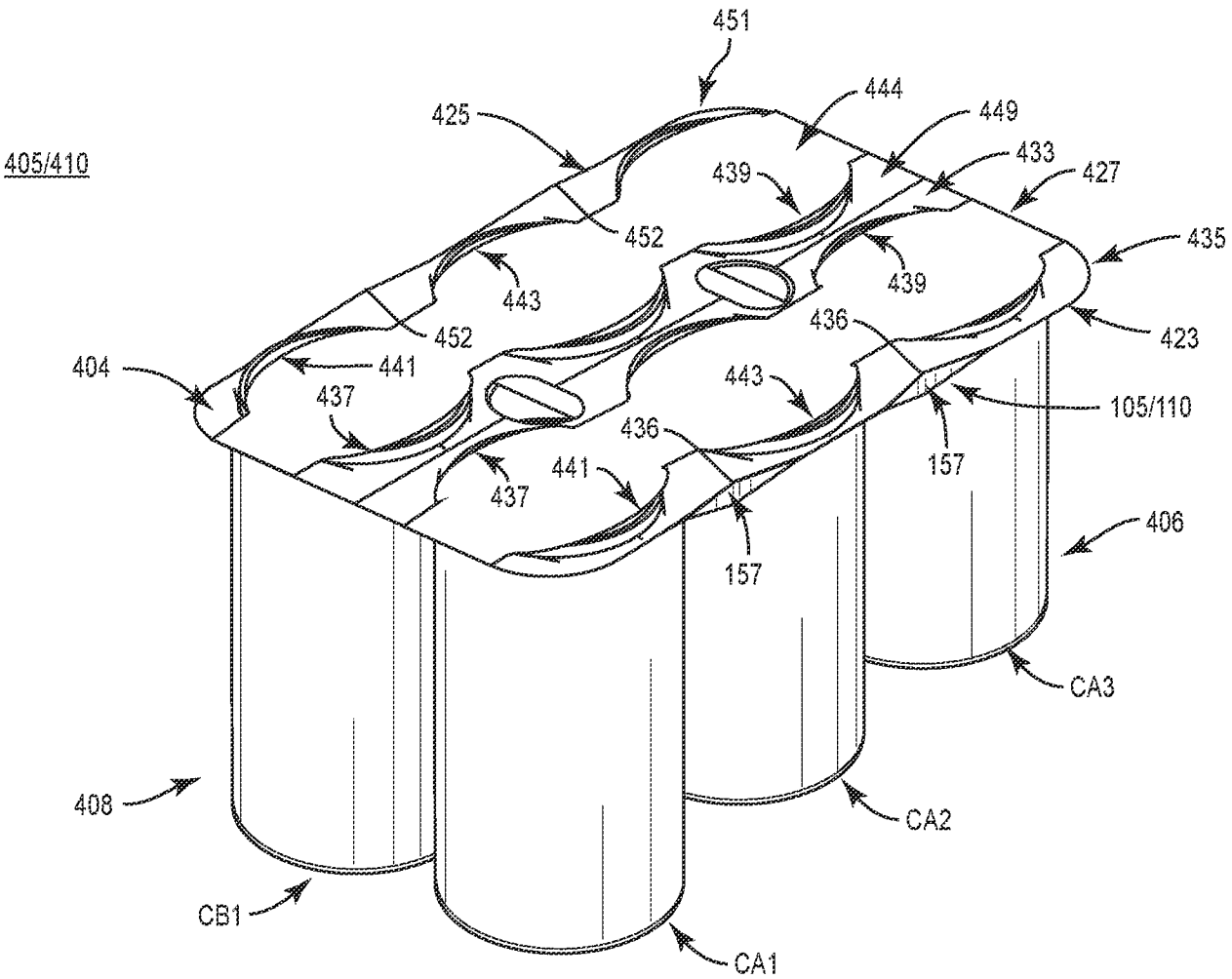
FIG. 10 is perspective view of a package including a top construct formed from the blank of FIG. 8 and the package of FIG. 2 according to the fourth exemplary embodiment of the disclosure.

As described further below, the upper blank 403 can form an upper construct or second construct 404 that cooperates with the carrier 105 of the first exemplary embodiment to form the carrier 405. In this regard, the blank 103 that forms the carrier 105 can be considered a first blank or lower blank, and the carrier 105 can be considered a first construct or lower construct. The carrier 405 can be provided with one or more containers to form a package 410 (FIG. 10).

The upper blank 403, as shown, can have the longitudinal axis L1 and the lateral axis L2. A grain direction M2 of the upper blank 403, e.g., a direction along which the fibers/fibrous components of the material from which the first blank 403 is formed (e.g., paperboard) generally lie, can be generally parallel to the longitudinal axis L1. It will be understood that the grain direction M2 can be generally parallel to the lateral axis L2 or can be defined along a direction oblique relative to the longitudinal axis L1 without departing from the disclosure.

As described herein, a grain direction M1 of the lower blank 103 (FIG. 1), can be generally parallel to the lateral axis L2, though the grain direction M2 can be generally parallel to the longitudinal axis L1 or can be defined along a direction oblique relative to the lateral axis L2 without departing from the disclosure.

Figure 8:
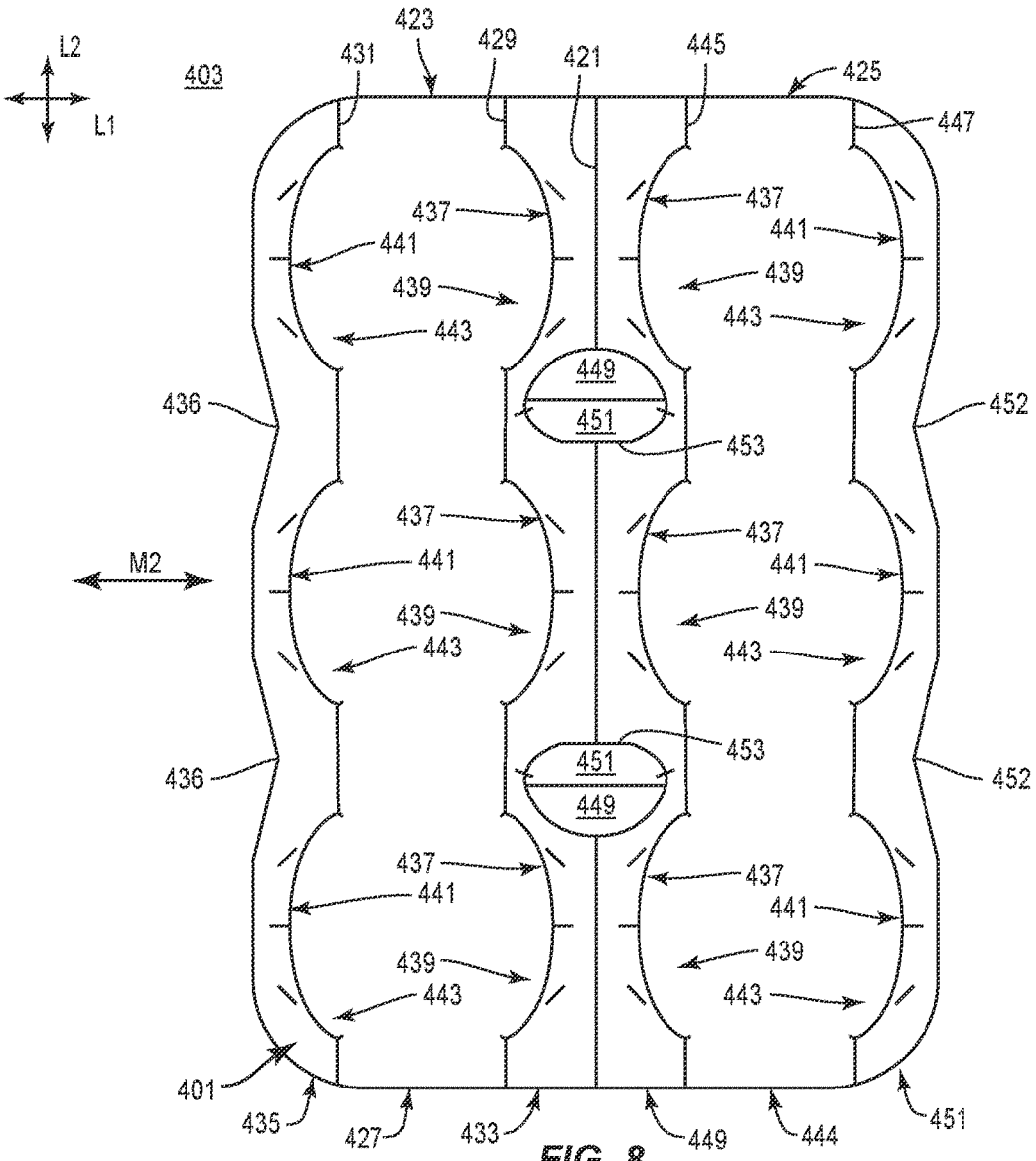
FIG. 8 is a plan view of an exterior surface of a top blank for at least partially forming a carrier according to a fourth exemplary embodiment of the disclosure.

With continued reference to FIG. 8, the upper blank 403 can have a front portion 407 for at least partially forming a front portion 406 of the carrier 405, and a back portion 409 for at least partially forming a back portion 408 of the carrier 405. The upper blank 403 can also include a front attachment panel 423 foldably connected to a back attachment panel 425 at a lateral fold line 421. The front attachment panel 423 can include a container retention portion 427 defined between a pair of lateral fold lines 429, 431 such that the container retention portion 427 is foldably connected to an interior marginal portion 433 of the front attachment panel 423 at the lateral fold line 429 and such that the container retention portion 427 is foldably connected to an exterior marginal portion 435 at the fold line 431. A pair of laterally-spaced notches or recessed portions 436 can be defined along a free edge of the front attachment panel 423.

The upper blank 403/upper construct 405 can include container retention features for at least partially receiving respective containers of the plurality of containers. As shown, the fold line 429 can be interrupted by a plurality of laterally-spaced curved cuts 437 that define container retention tabs 439 protruding from the container retention portion 427, and the fold line 431 can be interrupted by a plurality of laterally-spaced curved cuts 441 that define retention tabs 443 protruding from the container retention portion 427 opposite the container retention tabs 439. As shown, one or more relief cuts or lines of weakening can be positioned proximate or intersecting the respective cuts 437, 441.

Similarly, the back attachment panel 425 can have a container retention portion 443 defined between a pair of lateral fold lines 445, 447, an interior marginal portion 449 foldably connected to the container retention portion 443 at the fold line 445, and an exterior marginal portion 451 foldably connected to the container retention portion 453 at the fold line 447. The fold lines 445, 447 can be interrupted by respective pluralities of curved cuts 437, 441 so that the back attachment panel 425 can be provided with similar/identical container retention features associated with that described above with regard to the front attachment panel 423. A pair of laterally-spaced notches or recessed portions 452 can be defined along a free edge of the back attachment panel 425.

The blank 403/construct 405 can also include handle features including a pair of laterally-spaced handle openings 449 interrupting the fold line 421 and having respective handle reinforcement flaps 451 positioned extending into the respective handle openings 449 and foldably connected to respective portions of the attachment panels 423, 425 at respective lateral fold lines 453.

Figure 9:
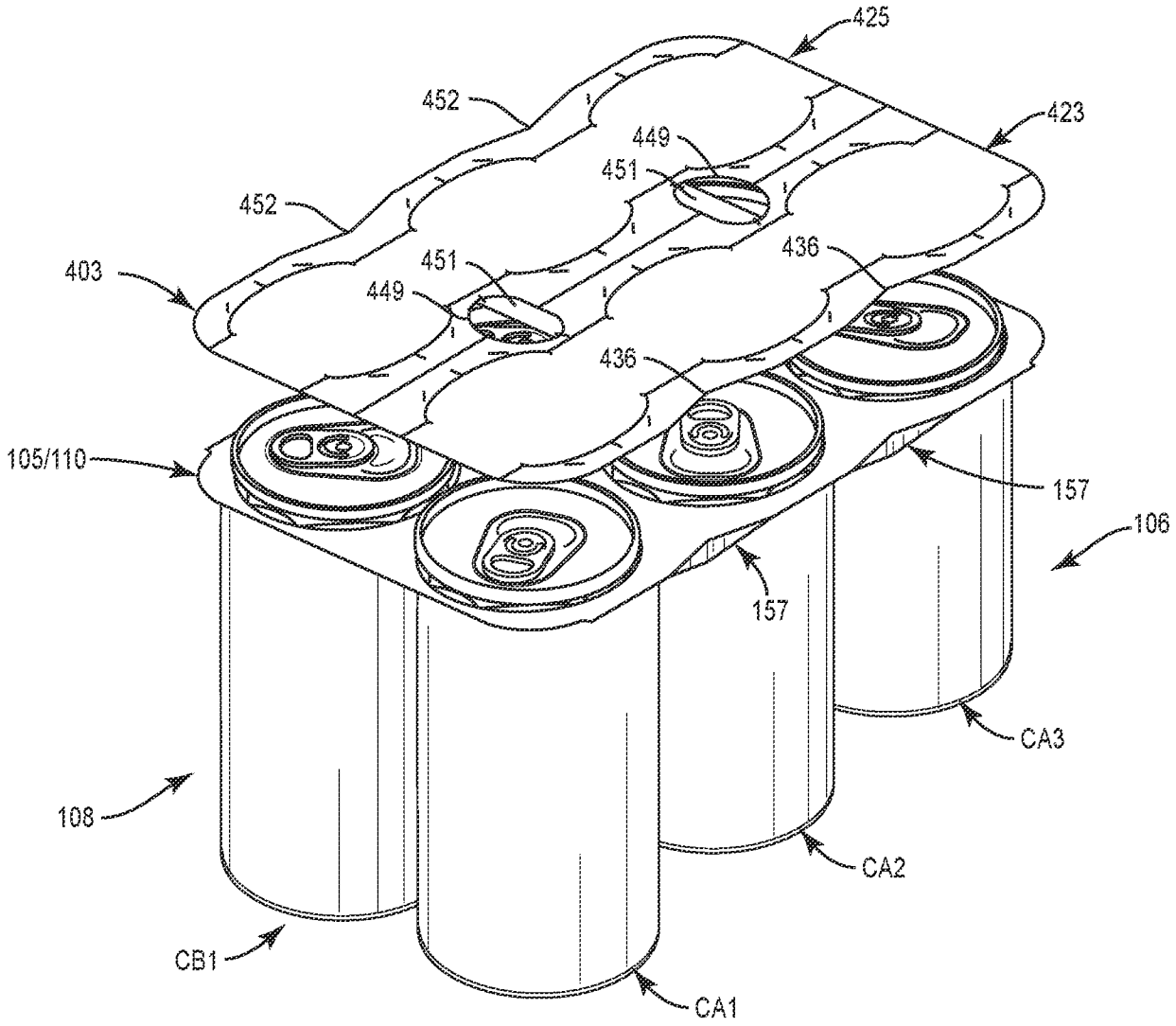
FIG. 9 is a perspective view of the top blank of FIG. 8 positioned above the package of FIG. 2 according to the fourth exemplary embodiment of the disclosure.

With additional reference to FIGS. 9 and 10, the carrier/lower construct 105 can be formed as described above, with regard to the first exemplary embodiment. Furthermore, one or more of the containers CA1, CA2, CA3, CB1, CB2, CB3 can be engaged with the carrier/lower construct 105 in the manner described above with regard to the first exemplary embodiment.

Thereafter, in order to form the carrier 405/package 410 according to one exemplary embodiment, the blank 403 can be lowered onto the carrier/lower construct 105 to activate the container retention features thereof and form the upper construct 405. For example, as an interior surface or underside of the blank 403 is placed atop the containers, the container retention portions 427, 443 can at least partially separate from the remainder of the respective attachment panels 423, 425 at the respective cuts 437, 441.

In such an arrangement, upper or top portions T of the respective containers CA1, CA2 can extend at least partially through respective openings formed by the respective cuts 437, 441 such that the container retention tabs 439, 443 can engage, for example, a recessed portion of a rim or other top structure of the respective containers CA1, CA2, CA3, CB1, CB2, CB3. In such an arrangement, a plurality of reconfigurable edges of the respective interior marginal portions 433, 449 and exterior marginal portions 435, 451 can engage, for example, a rolled rim edge or other top structure of the respective containers CA1, CA2, CA3, CB1, CB2, CB3.

The aforementioned reconfiguration of the blank 403 in the upper construct 405 can also cause the interior marginal portion 433 of the front attachment panel 423 to fold downwardly at the fold line 429 and the exterior marginal portion 435 of the front attachment panel 423 to fold downwardly at the fold line 431. Similarly, the interior marginal portion 449 of the back attachment panel 423 can fold downwardly at the fold line 445 and the exterior marginal portion 451 of the back attachment panel 425 can fold downwardly at the fold line 447.

The carrier 405/package 410 can be used in a similar manner to that described above with regard to the carriers 105, 205, 305/packages 110, 210, 310. In order to engage/move/carry the carrier 405/package 410, in one embodiment, a user can insert his or her finger(s) through one or both of the respective handle openings 449 to cause the handle reinforcement flaps 451 to fold downwardly at the respective fold lines 453 toward the handle tabs 141 of the lower construct/carrier 105. In this regard, the handle tabs 141 can separate from the top panel 125 in the manner described above with regard to the first exemplary embodiment to provide a respective opening in the top panel 125. A user can thus engage the underside of the container retention flaps 127, 131 and/or a portion of the top panel 125 in order to engage and lift/carry or otherwise move the carrier 405/package 410. The respective handle reinforcement flaps 451 and handle tabs 141 can be positioned between a user's finger(s) and respective portions of the underside of the carrier 405/package 410, e.g., for comfort, to avoid pinching, etc. and/or to provide a reinforced structure for engagement by the user that is resistant to tearing or other deformation due to carrying stresses. In one embodiment, a free edge of one or both of the handle tabs 451 can catch/engage a portion of the top panel 125 of the lower construct 105 to facilitate proper engagement of the carrier 405/package 410 by a user.

In order to remove one or more containers from the carrier 405/package 410, respective top portions T of the containers can be withdrawn through the openings formed by the respective cuts 437, 441 and the remainder of the respective attachment panels 423, 425 of the upper construct. The respective top portions T of the containers can further be withdrawn through respective aligned container retention openings 135, 147 of the lower construct 105 as described above with regard to the first exemplary embodiment.

The carrier 405/package 410 can provide advantages that are the same or similar to those described above with respect to the carriers 105, 205, 305 and packages 110, 210, 310 e.g., the container retention features and reinforcement panels thereof.

Furthermore, the aforementioned combination of the upper construct 404 and the lower construct 105 provides a carrier 405/package 410 with a robust and rigid configuration provided by the overlapping upper blank 403/construct 405 with the lower blank 103/lower construct 105 to provide enhanced strengthening properties to minimize/resist bending, buckling, flexion, torsion, etc. of the carrier 405/package 410 relative to a plane defined by the top panel 125 and/or the container retention flaps 127, 131 and/or the attachment panels 423, 425 in addition to the presence of the reinforcement panels 157, e.g., such that the carrier 405/package 410 minimizes/resists such forces/movement along both the longitudinal axis L1 and the lateral axis L2.

Further still, the aforementioned combination of the upper construct 404 and the lower construct 105 provides the carrier 405/package 410 with a robust and rigid configuration provided by the overlapping upper blank 403/construct 404 having the grain direction M2 and the lower blank 103/lower construct 105 having the grain direction M1 that is perpendicular to the grain direction M2 such that a cross-grain configuration is provided. Such cross-grain configuration of the carrier 405/package 410 can provide enhanced strengthening properties and resistance to tearing, e.g., since the carrier 405/package 410 is resistant to tearing in a direction perpendicular to the grain direction M1 as well as in a direction perpendicular to the grain direction M2. In this regard, the cross-grain configuration of the carrier 405/package 410 is such that enhanced resistance to tearing is provided along two perpendicular axes.

In addition, the positioning of the respective container retention portions 427, 433 overlapping the top portions T of the respective containers can provide, for example, additional advertising for product information (e.g., advertisements, pricing information, graphics/logos/images, promotional information, etc.), as well as forming a barrier that can minimize, inhibit, prevent, and/or otherwise avoid debris or other unwanted material from contacting the top portions T of the respective containers. Such protection/overlapping of the top portions T of the respective containers can provide consumers with an enhanced impression of sanitization and quality control with respect to the containers of the package 410.

The carrier 405/package 410 can have a different configuration without departing from the disclosure, and it will be understood that any of the blanks, carriers, and packages described herein can be provided in different configurations without departing from the disclosure. For example, in one exemplary embodiment, only one of the front attachment panel 423/interior marginal portion 433/exterior marginal portion 435 and associated features and the back attachment panel 425/interior marginal portion 449/exterior marginal portion 459 and associated features, so as to overlap only a respective front portion or back portion of the carrier/lower construct 105.

Figure 11:
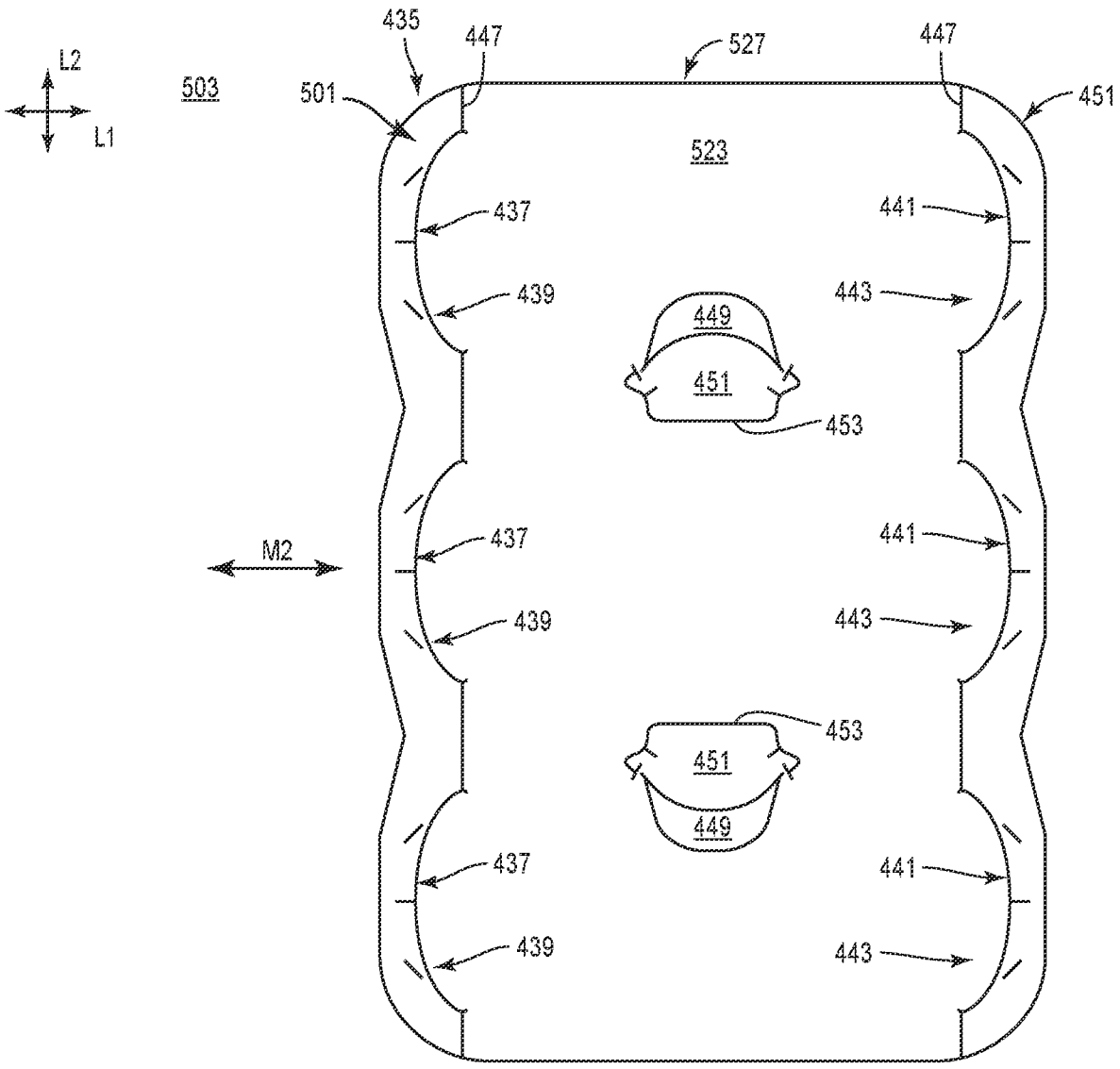
FIG. 11 is a plan view of an exterior surface of a top blank for at least partially forming a carrier according to a fifth exemplary embodiment of the disclosure.
Figure 12:
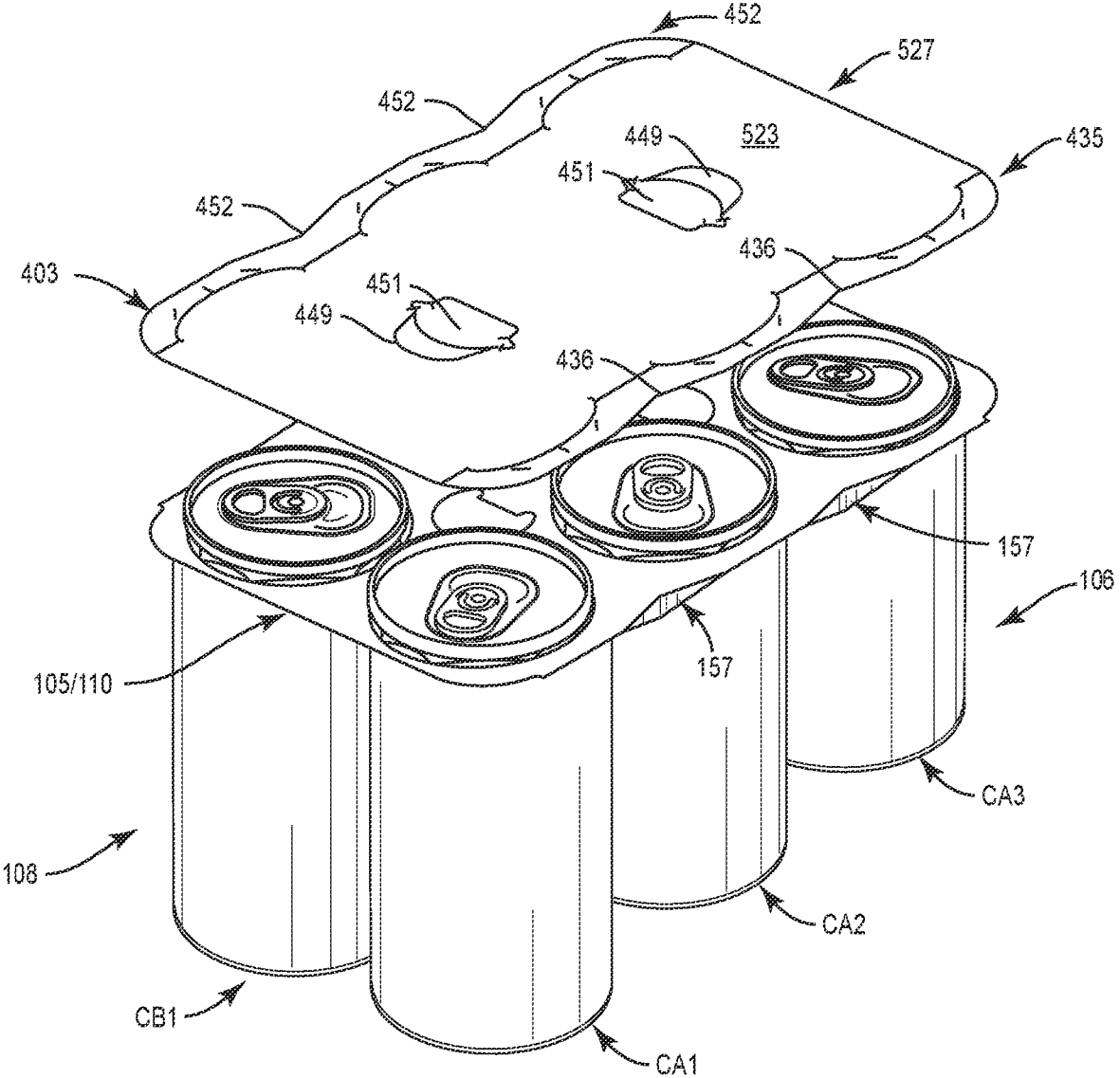
FIG. 12 is a perspective view of the top blank of FIG. 11 positioned above the package of FIG. 2 according to the fifth exemplary embodiment of the disclosure.
Figure 13:
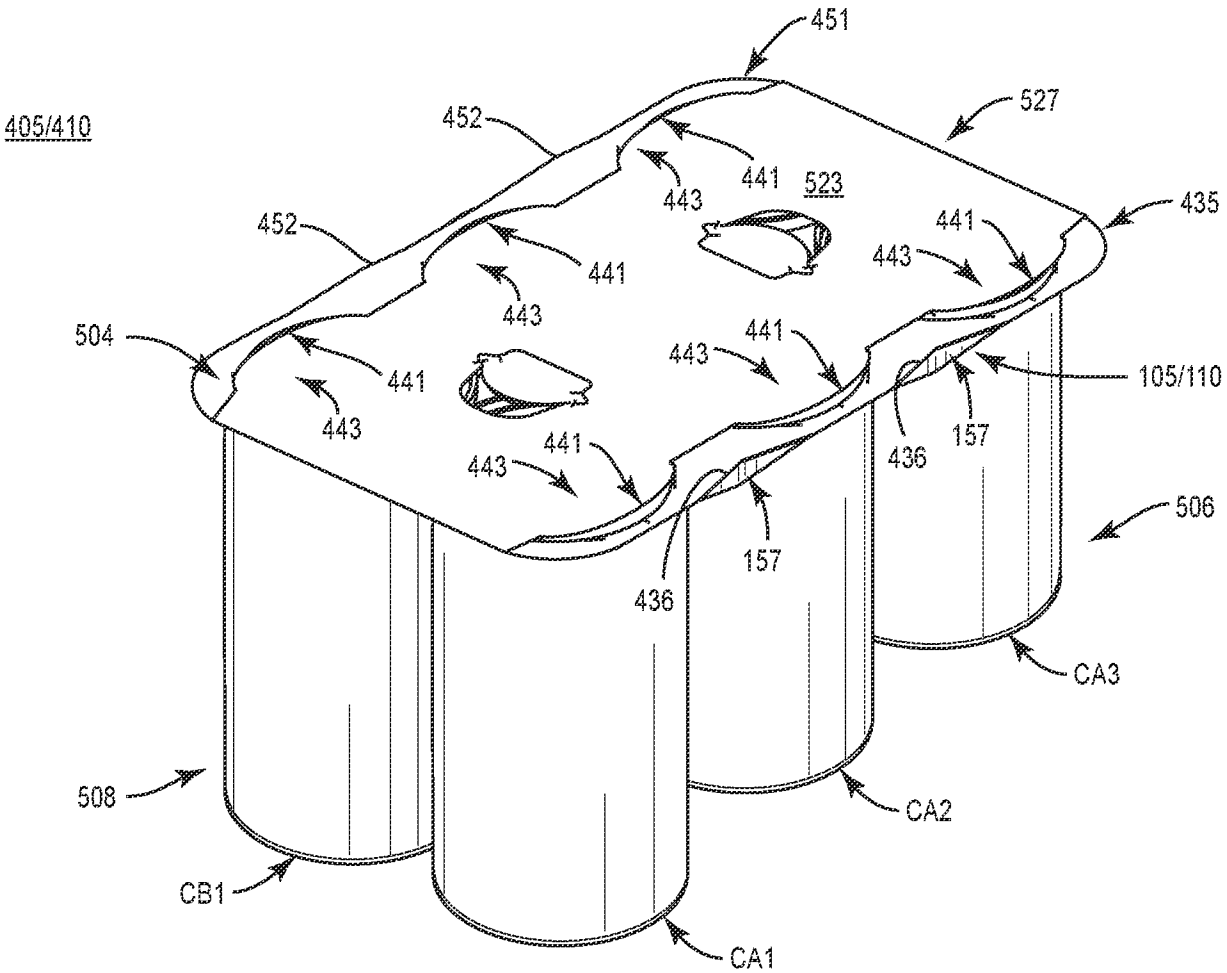
FIG. 13 is perspective view of a package including a top construct formed from the blank of FIG. 11 and the package of FIG. 2 according to the fifth exemplary embodiment of the disclosure.

Referring to FIG. 11, a plan view of an exterior surface 501 of a second blank or upper blank 503 for at least partially forming a carrier 505 (FIG. 13) is illustrated according to a fifth exemplary embodiment of the disclosure. The carrier 505 at least partially formed from the blank 503 can be provided with one or more containers to form a package 510.

The upper blank 503 can have one or more features that are the same or similar to those described above with respect to the upper blank 403 of the fourth exemplary embodiment, and like or similar features are designated with like or similar reference numerals.

As shown, the upper blank 503 can include the longitudinal axis L1, the lateral axis L2, and the grain direction M2. The blank 503 can have a front portion 507 for at least partially forming a front portion 508 of the carrier 505, and a back portion 509 for at least partially forming a back portion 508 of the carrier 505. The upper blank 503 can include a single attachment panel 523 forming a container retention portion 527, with the exterior marginal portion 435 foldably connected to the attachment panel 523 at the fold line 431, and with the exterior marginal portion 451 foldably connected to the attachment panel 523 at the fold line 447. The fold lines 431, 447 can be interrupted by the respective pluralities of curved cuts 437, 441 so as to provide container retention features as described above with respect to the upper blank 403 (FIG. 8) of the fourth exemplary embodiment.

The carrier 505/package 510 can be formed in a manner similar to that described above with regard to the carrier 405/package 410, e.g., the carrier 105 can be and engaged with one or more of the containers CAL CA2, CA3, CB1, CB2, CB3 can be engaged with the carrier 105, and the blank 503 can be lowered onto the carrier 105 to activate the container retention features thereof and form an upper construct 504.

Activation of the container retention features of the blank 503/construct 504 can include separation of the container retention portion 527 from the remainder of the respective portions panels 423, 425 at the respective cuts 437, 441. In such an arrangement, upper or top portions T of the respective containers CA1, CA2, CA3, CB1, CB2, CB3 can extend at least partially through respective openings formed by the respective cuts 437, 441 such that the container retention tabs 439, 443 can engage, for example, a recessed portion of a rim or other top structure of the respective containers CA1, CA2, CA3, CB1, CB2, CB3. In such an arrangement, a plurality of reconfigurable edges of the respective exterior marginal portions 435, 451 can engage, for example, a rolled rim edge or other top structure of the respective containers CA1, CA2, CA3, CB1, CB2, CB3.

The carrier 505/package 510 can provide advantages that are the same or similar to those described above with respect to the carriers 105, 205, 305, 405 and packages 110, 210, 310, 410 e.g., the container retention features and reinforcement panels thereof.

In general, the blank may be constructed from paperboard having a caliper so that it is heavier and more rigid than ordinary paper. The blank can also be constructed of other materials, such as cardboard, or any other material having properties suitable for enabling the carrier to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding thereal-ong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a top panel comprising a plurality of container retention openings for at least partially receiving a respective container of the plurality of containers;

at least one container retention flap foldably connected to the top panel at a fold line; and at least one reinforcement panel interrupting the fold line and positioned between the top panel and the at least one container retention flap.

2. The carrier of claim 1, wherein the at least one reinforcement panel is generally upright relative to the top panel.

3. The carrier of claim 2, wherein the at least one reinforcement panel is formed by a line of weakening.

4. The carrier of claim 3, wherein the line of weakening includes a plurality of oblique line segments, each oblique line segment of the plurality of oblique line segments intersecting at least one other line segment of the plurality of oblique line segments.

5. The carrier of claim 4, wherein the at least one reinforcement panel has a generally diamond-shaped configuration.

6. The carrier of claim 2, wherein the plurality of container retention openings in the top panel is a first plurality of container retention openings, the at least one container retention flap comprises a second plurality of container openings, the container openings of the first plurality of container retention openings being aligned with respective container retention openings of the second plurality of container retention openings.

7. The carrier of claim 6, wherein at least one container retention tab is foldably connected to the top panel at a respective fold line, the at least one container retention tab being positioned to extend into a respective container retention opening of the plurality of container retention openings.

8. The carrier of claim 6, wherein the at least one container retention flap is a first container retention flap, the fold line is a first fold line, the at least one reinforcement panel is a first reinforcement panel interrupting the first fold line, and the carrier further comprises a second container retention flap foldably connected to the top panel at a second fold line, the carrier further comprising a second reinforcement panel interrupting the second fold line.

9. The carrier of claim 2, further comprising at least one reinforcement flap foldably connected to the at least one container retention flap.

10. The carrier of claim 9, wherein the at least one container retention flap extends downwardly from the top panel and the at least one container retention flap.

11. The carrier of claim 10, wherein the at least one container retention flap is a first container retention flap, the carrier further comprises a second container retention flap foldably connected to the top panel, the at least one reinforcement flap is a first reinforcement flap foldably connected to the first container retention flap, and the carrier further comprises a second reinforcement flap foldably connected to the second container retention flap, the first reinforcement flap is in at least partial face-to-face contact with the second reinforcement flap.

12. The carrier of claim 2, wherein the top panel, the at least one container retention flap, and the at least one reinforcement panel form a lower construct of the carrier, and the carrier further comprises an upper construct at least partially overlapping the lower construct.

13. The carrier of claim 12, wherein the upper construct comprises at least one attachment panel, the at least one container retention panel comprises a container retention portion and at least one marginal portion foldably connected to the container retention portion, the upper construct comprising a plurality of cuts for at least partially receiving a respective container of the plurality of containers.

14. The carrier of claim 13, wherein the at least one attachment panel is a front attachment panel, the at least one marginal portion is an interior marginal portion foldably attached to the container retention portion of the front attachment panel, and the upper construct further comprises an exterior marginal portion foldably connected to the container retention portion of the front attachment panel, the upper construct further comprises a back attachment panel comprising a container retention portion, an interior marginal portion foldably connected to the container retention portion of the back attachment panel, and an exterior marginal portion foldably connected to the container retention portion of the back attachment panel.

15. A blank for forming a carrier for holding a plurality of containers, the blank comprising:

a top panel comprising a plurality of container retention openings for at least partially receiving a respective container of the plurality of containers when the carrier is formed from the blank;

at least one container retention flap foldably connected to the top panel at a fold line; and at least one reinforcement panel interrupting the fold line and positioned between the top panel and the at least one container retention flap.

16. The blank of claim 15, wherein the at least one reinforcement panel is formed by a line of weakening.

17. The blank of claim 16, wherein the line of weakening includes a plurality of oblique line segments, each oblique line segment of the plurality of oblique line segments intersecting at least one other line segment of the plurality of oblique line segments.

18. The blank of claim 17, wherein the at least one reinforcement panel has a generally diamond-shaped configuration.

19. The blank of claim 15, wherein the plurality of container retention openings in the top panel is a first plurality of container retention openings, the at least one container retention flap comprises a second plurality of container openings, the container openings of the first plurality of container retention openings are for being aligned with respective container retention openings of the second plurality of container retention openings when the carrier is formed from the blank.

20. The blank of claim 19, wherein at least one container retention tab is foldably connected to the top panel at a respective fold line, the at least one container retention tab being positioned to extend into a respective container retention opening of the plurality of container retention openings.

21. The blank of claim 19, wherein the at least one container retention flap is a first container retention flap, the fold line is a first fold line, the at least one reinforcement panel is a first reinforcement panel interrupting the first fold line, and the carrier further comprises a second container retention flap foldably connected to the top panel at a second fold line, the carrier further comprising a second reinforcement panel interrupting the second fold line.

22. The blank of claim 15, further comprising at least one reinforcement flap foldably connected to the at least one container retention flap.

23. The blank of claim 22, wherein the at least one container retention flap is a first container retention flap, the blank further comprises a second container retention flap foldably connected to the top panel, the at least one reinforcement flap is a first reinforcement flap foldably connected to the first container retention flap, and the blank further comprises a second reinforcement flap foldably connected to the second container retention flap.

24. The blank of claim 15, wherein the top panel, the at least one container retention flap, and the at least one reinforcement panel are part of a lower blank for forming a lower construct of the carrier formed from the blank, further in combination with an upper blank for forming an upper construct at least partially overlapping the lower construct when the carrier is formed from the upper blank and the lower blank.

25. The combination of claim 24, wherein the upper blank further comprises at least one attachment panel, the at least one container retention panel comprises a container retention portion and at least one marginal portion foldably connected to the container retention portion, the upper blank comprising a plurality of cuts for at least partially receiving a respective container of the plurality of containers when the carrier is formed from the upper blank and the lower blank.

26. The combination of claim 25, wherein the at least one attachment panel is a front attachment panel, the at least one marginal portion is an interior marginal portion foldably attached to the container retention portion of the front attachment panel, and the upper blank further comprises an exterior marginal portion foldably connected to the container retention portion of the front attachment panel, the upper blank further comprises a back attachment panel comprising a container retention portion, an interior marginal portion foldably connected to the container retention portion of the back attachment panel, and an exterior marginal portion foldably connected to the container retention portion of the back attachment panel.

27. A method of forming a carrier for holding a plurality of containers, the method comprising:

obtaining a blank comprising a top panel comprising a plurality of container retention openings, at least one container retention flap foldably connected to the top panel at a fold line, and at least one reinforcement panel interrupting the fold line and positioned between the top panel and the at least one container retention flap; and positioning the blank such that the plurality of container retention openings is positioned for at least partially receiving a respective container of the plurality of containers.

28. The method of claim 27, wherein the at least one reinforcement panel is positioned generally upright relative to the top panel.

29. The method of claim 28, wherein the at least one reinforcement panel is formed by a line of weakening.

30. The method of claim 29, wherein the line of weakening includes a plurality of oblique line segments, each oblique line segment of the plurality of oblique line segments intersecting at least one other line segment of the plurality of oblique line segments.

31. The method of claim 30, wherein the at least one reinforcement panel has a generally diamond-shaped configuration.

32. The method of claim 28, wherein the plurality of container retention openings in the top panel is a first plurality of container retention openings, the at least one container retention flap comprises a second plurality of container openings, the method further comprises folding the at least one container retention flap such that the container openings of the first plurality of container retention openings are aligned with respective container retention openings of the second plurality of container retention openings.

33. The method of claim 32, wherein at least one container retention tab is foldably connected to the top panel at a respective fold line, the at least one container retention tab being positioned to extend into a respective container retention opening of the plurality of container retention openings.

34. The method of claim 32, wherein the at least one container retention flap is a first container retention flap, the fold line is a first fold line, the at least one reinforcement panel is a first reinforcement panel interrupting the first fold line, and the carrier further comprises a second container retention flap foldably connected to the top panel at a second fold line, the carrier further comprising a second reinforcement panel interrupting the second fold line.

35. The method of claim 28, further comprising at least one reinforcement flap foldably connected to the at least one container retention flap.

36. The method of claim 35, wherein the at least one container retention flap extends downwardly from the top panel and the at least one container retention flap.

37. The method of claim 36, wherein the at least one container retention flap is a first container retention flap, the carrier further comprises a second container retention flap foldably connected to the top panel, the at least one reinforcement flap is a first reinforcement flap foldably connected to the first container retention flap, and the carrier further comprises a second reinforcement flap foldably connected to the second container retention flap, the first reinforcement flap is in at least partial face-to-face contact with the second reinforcement flap.

38. The method of claim 28, wherein the top panel, the at least one container retention flap, and the at least one reinforcement panel form a lower construct of the carrier, and the method further comprises positioning an upper construct at least partially overlapping the lower construct.

39. The method of claim 38, wherein the upper construct comprises at least one attachment panel, the at least one container retention panel comprises a container retention portion and at least one marginal portion foldably connected to the container retention portion, the upper construct comprising a plurality of cuts for at least partially receiving a respective container of the plurality of containers.

40. The method of claim 39, wherein the at least one attachment panel is a front attachment panel, the at least one marginal portion is an interior marginal portion foldably attached to the container retention portion of the front attachment panel, and the upper construct further comprises an exterior marginal portion foldably connected to the container retention portion of the front attachment panel, the upper construct further comprises a back attachment panel comprising a container retention portion, an interior marginal portion foldably connected to the container retention portion of the back attachment panel, and an exterior marginal portion foldably connected to the container retention portion of the back attachment panel.

41. A package, the package comprising:

a plurality of containers; and a carrier holding the plurality of containers, the carrier comprising:

a top panel comprising a plurality of container retention openings at least partially receiving a respective container of the plurality of containers;

at least one container retention flap foldably connected to the top panel at a fold line; and at least one reinforcement panel interrupting the fold line and positioned between the top panel and the at least one container retention flap.

42. The package of claim 41, wherein the at least one reinforcement panel is generally upright relative to the top panel.

43. The package of claim 41, wherein the at least one reinforcement panel is formed by a line of weakening.

44. The package of claim 43, wherein the line of weakening includes a plurality of oblique line segments, each oblique line segment of the plurality of oblique line segments intersecting at least one other line segment of the plurality of oblique line segments.

45. The package of claim 44, wherein the at least one reinforcement panel has a generally diamond-shaped configuration.

46. The package of claim 42, wherein the plurality of container retention openings in the top panel is a first plurality of container retention openings, the at least one container retention flap comprises a second plurality of container openings, the container openings of the first plurality of container retention openings being aligned with respective container retention openings of the second plurality of container retention openings.

47. The package of claim 46, wherein at least one container retention tab is foldably connected to the top panel at a respective fold line, the at least one container retention tab being positioned to extend into a respective container retention opening of the plurality of container retention openings.

48. The package of claim 46, wherein the at least one container retention flap is a first container retention flap, the fold line is a first fold line, the at least one reinforcement panel is a first reinforcement panel interrupting the first fold line, and the carrier further comprises a second container retention flap foldably connected to the top panel at a second fold line, the carrier further comprising a second reinforcement panel interrupting the second fold line.

49. The package of claim 41, further comprising at least one reinforcement flap foldably connected to the at least one container retention flap.

50. The package of claim 49, wherein the at least one container retention flap extends downwardly from the top panel and the at least one container retention flap.

51. The package of claim 50, wherein the at least one container retention flap is a first container retention flap, the carrier further comprises a second container retention flap foldably connected to the top panel, the at least one reinforcement flap is a first reinforcement flap foldably connected to the first container retention flap, and the carrier further comprises a second reinforcement flap foldably connected to the second container retention flap, the first reinforcement flap is in at least partial face-to-face contact with the second reinforcement flap.

52. The package of claim 41, wherein the top panel, the at least one container retention flap, and the at least one reinforcement panel form a lower construct of the carrier, and the carrier further comprises an upper construct at least partially overlapping the lower construct.

53. The package of claim 52, wherein the upper construct comprises at least one attachment panel, the at least one container retention panel comprises a container retention portion and at least one marginal portion foldably connected to the container retention portion, the upper construct comprising a plurality of cuts for at least partially receiving a respective container of the plurality of containers.

54. The package of claim 53, wherein the at least one attachment panel is a front attachment panel, the at least one marginal portion is an interior marginal portion foldably attached to the container retention portion of the front attachment panel, and the upper construct further comprises an exterior marginal portion foldably connected to the container retention portion of the front attachment panel, the upper construct further comprises a back attachment panel comprising a container retention portion, an interior marginal portion foldably connected to the container retention portion of the back attachment panel, and an exterior marginal portion foldably connected to the container retention portion of the back attachment panel.

* * * * *